US006002080A

United States Patent [19]

Tanaka

[11] Patent Number: 6,002,080

[45] Date of Patent: Dec. 14, 1999

[54] ELECTRONIC WIND INSTRUMENT CAPABLE OF DIVERSIFIED PERFORMANCE EXPRESSION

[75] Inventor: So Tanaka, Hamamatsu, Japan

[73] Assignee: Yahama Corporation, Hamamatsu, Japan

[21] Appl. No.: 09/098,131

[22] Filed: Jun. 16, 1998

[30] Foreign Application Priority Data

| | | | |
|---|---|---|---|
| Jun. 17, 1997 | [JP] | Japan | 9-160243 |
| Oct. 16, 1997 | [JP] | Japan | 9-283812 |
| Jan. 28, 1998 | [JP] | Japan | 10-031979 |

[51] Int. Cl.[6] ..... G10H 1/18; G10D 7/00

[52] U.S. Cl. ..... 84/615; 84/609; 84/616; 84/626; 84/649; 84/653; 84/654; 84/662

[58] Field of Search ..... 84/601–602, 604, 84/609, 615–616, 619, 622, 626, 649, 653–654, 657, 659, 662, 709

[56] References Cited

U.S. PATENT DOCUMENTS

| | | | |
|---|---|---|---|
| 4,939,975 | 7/1990 | Sakashita | 84/626 |
| 5,125,315 | 6/1992 | Kawashima . | |

FOREIGN PATENT DOCUMENTS

| | | |
|---|---|---|
| 56-26798 | 3/1981 | Japan . |
| 63-318597 | 12/1988 | Japan . |
| 1-251098 | 10/1989 | Japan . |
| 3-108299 | 11/1991 | Japan . |
| 7-34470 | 8/1995 | Japan . |
| 8-305362 | 11/1996 | Japan . |

*Primary Examiner*—Robert E. Nappi
*Assistant Examiner*—Marlon T. Fletcher
*Attorney, Agent, or Firm*—Pillsbury Madison & Sutro LLP

[57] ABSTRACT

There are provided a plurality of keys for designating a pitch and a plurality of sensors for detecting operating states of the keys. Main pitch determination section identifies respective ON/OFF states of the keys on the basis of output values from the sensors to thereby determines a performed pitch. When the output value from the sensor, corresponding to a particular one of the keys determined to be in the ON or OFF state, presents a predetermined intermediate value, a subsidiary pitch determination section determines another pitch on the basis of predetermined assumptive ON/OFF states of the keys. The assumptive ON/OFF states are similar to the ON/OFF states of the keys identified by the main pitch determination section except that the ON or OFF state of the particular key is inverted to the OFF or ON state. Pitch-bend information designating an intermediate pitch between the other pitch and the pitch determined by the main pitch determination section is generated, such as by interpolation, on the basis of the sensor output presenting the predetermined intermediate value. On the basis of the sensor output corresponding to the predetermined turned-ON key, a tone control signal can be generated to execute after-touch control. Any one of functions allocated to a predetermined key, such as a high trill key, may be selectively used depending on a selected mode.

26 Claims, 20 Drawing Sheets

TBL1

| D1 | D2 | U1 | U2 | OUTPUT |
|---|---|---|---|---|
| 1 | 0 | 0 | 0 | −2 |
| 1 | 1 | 0 | 0 | −2 |
| 0 | 1 | 0 | 0 | −1 |
| 0 | 0 | 0 | 0 | 0 |
| 0 | 0 | 1 | 0 | +1 |
| 0 | 0 | 1 | 1 | +2 |
| 0 | 0 | 0 | 1 | +2 |

FIG. 18A

TBL2

| D1 | D2 | U1 | U2 | OUTPUT |
|---|---|---|---|---|
| 1 | 0 | 0 | 0 | CNN |
| 1 | 1 | 0 | 0 | CNN |
| 0 | 1 | 0 | 0 | −1 |
| 0 | 0 | 0 | 0 | 0 |
| 0 | 0 | 1 | 0 | +1 |
| 0 | 0 | 1 | 1 | CNN |
| 0 | 0 | 0 | 1 | CNN |

FIG. 18B

ELECTRONIC WIND INSTRUMENT CAPABLE OF DIVERSIFIED PERFORMANCE EXPRESSION

BACKGROUND OF THE INVENTION

The present invention relates to an electronic wind instrument capable of imparting expression to a performed tone on the basis of a performance technique or style as commonly employed with natural wind instruments, or to a musical performance input device capable of functioning as an equivalent electronic wind instrument.

Conventionally-known electronic wind instruments are similar in overall external shape to natural wind instruments. Such conventionally-known electronic wind instruments have a plurality of pitch-designating keys arranged or positioned in a generally similar manner to the natural wind instruments, and generate tones in colors or timbres similar to those of the natural wind instruments. The electronic wind instruments do not require a particular resonating section by virtue of their electronic nature, and instead include a variety of tone controlling operators such as tone pitch operators.

For example, Japanese Patent Publication No. HEI-6-97396 discloses a pitch bender device that is designed to slightly vary the pitch of a generated tone, such as for a vibrato effect, in response to displacement of a predetermined lever operatively connected to an mouth operator in the form of a false reed. The disclosed pitch bender device also includes a separate pitch-bend lever positioned centrally on a tubular body of the device, which provides for upward and downward pitch variations by about a half octave as well as pitch-bend control similar to the above-mentioned. There have also been known other electronic wind instruments, which are designed to afford an enhanced performance expression by imparting additional functions to the pitch-designating keys. Examples of the electronic wind instruments having heretofore been proposed include the ones which detect a velocity with which a key is depressed (key velocity) (Japanese Patent Laid-open Publication Nos. HEI-8-305362 and HEI-251098 and Japanese Utility Model Publication No. HEI-7-34470), as well as the ones which detect a key depression intensity by use of pressure-sensitive sensors in the key system (Japanese Utility Model Laid-open Publication No. HEI-3-108299). Further, Japanese Utility Model Laid-open Publication No. SHO-56-26798 and U.S. Pat. No. 5,125,315 propose electronic wind instruments which designate a tone pitch on the basis of a combination of ON/OFF states of a plurality of keys.

Today, diversified performance expression has been demanded more and more of the electronic wind instruments. Examples of the demanded performance expression concern a slur performance for smoothly interconnecting two different tone pitches, a tone color variation based on after-touch information, extension of the range of expressible tone pitches, and easier variations of tone color, volume, pitch, etc. In order to achieve such diversified performance expression, it is desirable that a human player be allowed to easily operate the electronic wind instrument. However, to date, no electronic wind instrument has been developed or proposed which provides for such diversified performance expression.

By contrast, natural wind instruments are capable of diversified performance expression as desired by the human player. Among various performance techniques or styles to achieve such diversified performance expression is the so-called "alternate fingering". In general, the term "alternate fingering" has two different meanings or concepts. In one meaning that is more standard than the other, the alternate fingering refers to different fingering (finger placement) techniques capable of generating a same tone pitch (scale note), which allow for tone generation using the easier-to-execute finger placement depending on the flow of necessary performance operations. In the other meaning, the alternate fingering refers to a fingering technique for varying the color or timbre of a generated tone by applying or not applying a finger action to a predetermined key or hole near the open end of the instrument's tubular body while still maintaining the basic fingering for generating a desired scale note. The alternate fingering in this case varies not only the color but also the pitch of the generated tone. Such alternate fingering is often used in the field of jazz and light music to add musical "ride" or "originality" to a performance. In the following description, the first-said alternate fingering will be called "standard alternate fingering", while the second-said alternate fingering will be called "special alternate fingering". The present invention described in the specification primarily concerns approximating or simulating the second-said, i.e., special alternate fingering.

Some electronic musical instruments have been known which attempt to approximate the alternate fingering in natural musical instruments, but these known instruments can only approximate the standard alternate fingering. Further, in cases where a plurality of performance styles are available to perform a tone of a same desired pitch and different tone colors corresponding to the performance styles are to be selectively used, it has so far been proposed to identify one of the performance styles actually employed and perform tone color control corresponding to the identified performance style. However, the proposed technique is designed to merely add tone color control by applying the alternate fingering and is never positively intended to provide for approximation or simulation of the above-mentioned "special" alternate fingering in electronic musical instruments.

Further, in the conventionally-known electronic wind instruments, start/stop of generation of a tone are controlled by human player's breath pressure from the mouthpiece as in the natural wind instruments. Therefore, generation of a tone can not be controlled with "attack" characteristics (i.e., tonal characteristics of "attack portion") before the breath pressure from the mouthpiece increases from zero to a predetermined level or value above zero.

Furthermore, because the above-mentioned conventional technique, which permits approximation of the alternate fingering in electronic musical instruments, can only approximate the "standard" alternate fingering, it is unable to finely control the tone pitch depending on the alternate fingering employed, although it can additionally execute tone color control. Thus, the conventional technique never contemplates approximating the special alternate fingering and is never sufficient to achieve musical performance rich in expression.

In general, the above-mentioned special alternate fingering in an actual performance is carried out by repetitively depressing and releasing or opening and closing a predetermined key or hole near the open end of the instrument's tubular body while still maintaining the basic fingering for generating a desired scale note. More specifically, as long as only the basic fingering is employed, the pitch of each generated tone is maintained at a predetermined regular scale note corresponding to that basic fingering; however, as the special alternate fingering is applied (namely, as a player's finger action is carried out to depress or close the predetermined key or hole near the open end of the body), the color and pitch of the generated tone are varied. Then, as the special alternate fingering is terminated (namely, as the player's finger action is discontinued to release or open the predetermined key or hole), the regular or original color and pitch of the generated tone are restored. Subtle pitch control may be achieved to some extent by the conventional standard alternate fingering technique; that is, in this case, it is ascertained whether a detected alternate fingering performance is the special alternate fingering, and if so, the pitch of a scale note corresponding to the basic fingering may be subtly controlled by an amount as dictated by predetermined pitch-bend data. However, because such an arrangement would only result in a very simple and common form of pitch-bend control just causing the tone generation control of a scale note, corresponding to the basic fingering, to continue to subtly bend-control the pitch of the scale note, the generated tone would unavoidably lack musical expression. That is, the simple pitch-bend control of the generated tone is never sufficient for approximating the "special" alternate fingering as a style of performance rich in musical expression.

SUMMARY OF THE INVENTION

It is therefore an object of the present invention to provide an electronic wind instrument which achieves enhanced performability and diversified musical expression. Specifically, the present invention seeks to provide a device and method suitable for use with an electronic wind instrument or electronic musical instrument designed to designate a desired scale note on the basis of a combination of operation of a single key or a plurality of keys, which allows an intermediate pitch between scale notes to be easily designated as desired by a human player. The present invention also seeks to provide an electronic wind instrument which designates a desired pitch in response to human player's key operation and which allows a tone to be easily controlled, as desired by the human player in response to an amount of the key operation, during sustained generation of the tone. Further, the present invention seeks to provide an electronic wind instrument which allows pitch designating or controlling keys to be used as keys for controlling a tonal factor other than the pitch and thereby achieves enhanced performability and controllability.

It is another object of the present invention to provide an electronic wind instrument which is capable of approximating or simulating the special alternate fingering. The present invention also seeks to impart slight modulation to a generated tone to thereby further enrich performance expression, when approximating the special alternate fingering in the electronic wind instrument. Further, the present invention seeks to provide an electronic wind instrument which is capable of approximating the special alternate fingering by finely controlling not only the color and pitch of a generated tone as a predetermined performance operation based on some alternate fingering technique is executed.

In order to accomplish one of the above-mentioned objects, the present invention provides an electronic musical instrument which comprises: a plurality of keys that are operated to designate a pitch; a plurality of sensors each of which detects an operating state of a different one of the keys; a main pitch determination section that identifies respective ON/OFF states of the keys on the basis of output values from the sensors and determines a designated pitch on the basis of the respective ON/OFF states of the keys; a subsidiary pitch determination section that, when an output value from the sensor corresponding to a particular one of the keys determined by the main pitch determination section to be in the ON or OFF state, presents a predetermined intermediate value, determines another pitch on the basis of predetermined assumptive ON/OFF states of the keys, the assumptive ON/OFF states being similar to the ON/OFF states of the keys identified by the main pitch determination section except that the ON or OFF state of the particular key is inverted to the OFF or ON state; and a pitch-bend information generation section that, when the other pitch is determined by the subsidiary pitch determination section, generates pitch-bend information designating an intermediate pitch between the other pitch and the pitch determined by the main pitch determination section.

For example, the main pitch determination section identifies the respective ON/OFF states of the individual keys in accordance with a predetermined criterion and determines a pitch of a given scale note on the basis of the identified ON/OFF states of the keys. For the same operating states of the keys, the subsidiary pitch determination section determines a pitch of another or different scale note on the basis of predetermined assumptive ON/OFF states of the keys, when the output value from the sensor, corresponding to a particular one of the keys determined by the main pitch determination section to be in the ON or OFF state, presents a predetermined intermediate value. Namely, when the main pitch determination section determines a particular key, whose corresponding sensor presents a predetermined intermediate value, to be in the ON state, the subsidiary pitch determination section inverts the ON state of the particular key to the OFF state; similarly, when the main pitch determination section determines a particular key, whose corresponding sensor presents a predetermined intermediate value, to be in the OFF state, the subsidiary pitch determination section inverts the OFF state of the particular key to the ON state. Because of such inversion, the assumptive ON/OFF states of the keys is different from the ON/OFF states of the keys identified by the main pitch determination section, so that another pitch than the pitch determined by the main pitch determination section can be determined. Once the other pitch is determined by the subsidiary pitch determination section, pitch-bend information is generated which designates an intermediate pitch between the other pitch and the pitch determined by the main pitch determination section. The level of the intermediate pitch, i.e., the deviation or pitch-bend amount from the pitch determined by the main pitch determination section or from the other pitch determined by the subsidiary pitch determination section may be determined on the basis of the output value from the sensor corresponding to a predetermined one of the keys. In this way, an intermediate pitch between scale notes can be designated easily as desired by a human player. For example, an intermediate pitch between notes "B" and "C" can be designated by executing a key performance operation designating note "B" along with an intermediate key operation designating note "C" that could not be identified as such by the main pitch determination section; in this case, the level of the intermediate pitch (pitch-bend amount) can be variably controlled by varying the amount of the intermediate key operation. In case the other pitch is not determined by the subsidiary pitch determination section, the pitch determined by the main pitch determination section is of course set as the pitch of a tone to be generated as in the conventional technique.

In order to accomplish another object, the present invention provides an electronic wind instrument which comprises: a mouth operator that approximates a player's blow for controlling generation of a tone; a plurality of keys that are operated to designate a pitch; a plurality of sensors each of which detects an operated amount of a different one of the keys; a pitch determination section that identifies respective ON/OFF states of the keys on the basis of output values from the sensors and determines a designated pitch on the basis of the respective ON/OFF states of the keys; and a tone control signal generation section that generates a tone control signal on the basis of the output value from the sensor corresponding to a predetermined one of the keys determined by the pitch determination section to be in the ON state. Here, the pitch of the tone controlled by the mouth operator is determined by the pitch determination section and the tone is controlled by the tone control signal.

Thus, by designating a pitch via operation of a key and controlling the mouthpiece, a tone can be easily controlled, as desired by the human player in response to an amount of the key operation, during sustained generation of the tone, which would achieve after-touch control in the electronic wind instrument.

In order to accomplish still another object, the present invention provides an electronic wind instrument which comprises: a mouth operator that approximates a player's blow for controlling generation of a tone; a plurality of keys that are operated to designate a pitch; a mode selection section that selectively places a function of a predetermined one of the keys in one of pitch-designating and tone-controlling modes; a pitch determination section that determines a designated pitch on the basis of respective ON/OFF states of all of the keys, including the predetermined key, when the predetermined key is placed in the pitch-designating mode, the pitch determination section determining the pitch on the basis of the ON/OFF states of the keys, excluding the predetermined key, when the predetermined key is placed in the tone-controlling mode; and a tone control parameter generation section that, when the predetermined key is placed in the tone-controlling mode, generates a tone control parameter on the basis of the output of the predetermined key. Here, the pitch of the tone controlled by the mouth operator is determined by the pitch determination section and the tone is controlled by the tone control parameter.

With this arrangement, the function of the predetermined key can be selectively shifted between the pitch-designating and tone-controlling modes, which can enhance the performability and controllability of the electronic wind instrument.

The present invention also provides an electronic wind instrument which comprises: a mouth operator that approximates a player's blow for controlling generation of a tone; a plurality of keys that are operated to designate a pitch; a pitch determination section that determines a pitch on the basis of a combination of respective operating states of the keys; an octave control operator that is operated to modify, by the octave, the pitch determined by the pitch determination section; a mode selection section that selectively places a function of the octave control operator in one of octave-controlling and tone-controlling modes, only octave control corresponding to the operating state of the octave control operator being executed when the octave control operator is in the octave-controlling mode, tone control corresponding to the operating state of the octave control operator being permitted when the octave control operator is in the tone-controlling mode; and a tone control parameter generation section that, when the octave control operator is in the tone-controlling mode, generates a tone control parameter in accordance with the operating state of the octave control operator.

This arrangement also allows the function of the predetermined key to be selectively shifted between the pitch-designating and tone-controlling modes, which can enhance the performability and controllability of the electronic wind instrument.

In order to accomplish still another object, the present invention also provides an electronic wind instrument which comprises: a plurality of note-performing keys; a note determination section that determines a performed note on the basis of a combination of respective operating states of the keys, the note determination section being capable of determining a desired note on the basis of a predetermined combination of the operating states of the keys corresponding to basic fingering for the desired note and also on the basis of a predetermined combination of the operating states of the keys corresponding to predetermined alternate fingering for the desired note; and a control section that, when the predetermined alternate fingering is executed, newly issues note-on information corresponding to the predetermined alternate fingering, the control section instructing that a tone corresponding to the note determined by the note determination section be generated with "attack" characteristics in response to issuance of the note-on information.

Because note-on information is newly issued, in response to execution of a key operation corresponding to predetermined alternate fingering, to thereby instruct that a tone be generated with "attack" characteristics, the tone generation can be controlled with the "attack" characteristics even though tone generation control, such as by breath pressure from the mouthpiece, is instructing sustention of the generated tone. Thus, when a predetermined key operation corresponding to predetermined alternate fingering is executed or added in the course of a performance based on the basic fingering for a desired note, the note determination section detects that the desired note has been performed in accordance with the predetermined alternate fingering and can appropriately determine the same desired note, and also a tone corresponding to the note determined by the note determination section can be generated with "attack" characteristics in response to issuance of note-on information issued by the control section.

As conventionally known, a tone generator, having received the newly issued note-on information, judges the note-on information to be the advent of a new key-on event and controls the overall tone generating operations in such a manner to start generating the new tone (tone of the same note as the last tone) corresponding to the alternate fingering with the "attack" characteristics. For example, various tonal factors, such as a tone waveform, tone volume envelope, filter control envelope and pitch control envelope, will be controlled, starting with their respective "attack" characteristics. Therefore, when special alternate fingering is used as mentioned above, the present invention can control the new tone with tonal characteristics of attack portion to impart significant modulation, even though the new tone is of the same note as the last or preceding tone. Therefore, the present invention can even further enhance performance expression.

In order to enhance the approximating performance, it is desirable to finely control the color and pitch of the generated tone in a variable manner, by generating predetermined tone color control information and tone pitch control information in response to execution of key operation corresponding to the predetermined alternate fingering. In such a case, the control section newly issues note-on information designating a note that differs, by a semitone, from a desired note corresponding to the basic fingering and also generates pitch control information instructing that the note designated by the note-on information be shifted in pitch toward the desired note by a predetermined number of cents. When the pitch is to be shifted upward by "x" cents relative to the regular pitch of the desired note, the control section may issue note-on information designating a note higher than the desired note by a semitone (100 cents) and pitch control information designating a note lower than the desired note by "100–x" cents. By so doing, the tone generator, having received these pieces of information, can generate a tone having a pitch shifted upward "x" cents from the regular pitch of the desired note, by controlling the tone, higher in pitch than the desired note by a semitone, to assume a pitch lower by "100–x" cents. Conversely, when the pitch is to be shifted downward by "x" cents relative to the regular pitch of the desired note, the control section may issue note-on information designating a note lower than the desired note by a semitone (100 cents) and pitch control information designating a note higher than the desired note by "100–x" cents. If it is desired to subtly control the pitch in a variable manner without completely losing the feeling of the desired note's regular pitch, then the above-mentioned pitch shift amount "x" may be set to an appropriate value below 50 cents. It is advantageous to thus set the note-designating information in the note-on information to be higher or lower, by a semitone, than a predetermined note corresponding to the alternate fingering instead of the predetermined note itself and to set the pitch control information as a pitch difference value such that a desired pitch shift amount "x" can be ultimately obtained, because it is possible to handle the last and new tones as completely different notes in terms of the form of the note-on information. For instance, in cases where a different memory is employed for each note or pitch range or where different tone control is applied to each note or pitch range as well as each tone color waveform, generation of the new tone can be initiated and controlled uniquely as a completely different note from the last tone, which can thus impart diversified expression to the performed tone.

In is also important to note that in newly issuing note-on information to control the new tone with characteristics of its attack portion, note-off information may of course be issued, as necessary, to mute the last tone. Also, when an additional key operation for the special alternate fingering is terminated to restore the basic fingering, note-off information may be generated with respect to the preceding tone (i.e., tone corresponding to the special alternate fingering) and note-on information may be issued with respect to the new tone (i.e., tone corresponding to the basic fingering), so that tone control can be performed, with significant modulation imparted to the performed tone, each time when performance by the special alternate fingering is repeated.

The present invention may be embodied in "method" form as well as in "device" form. The present invention may also be implemented as a computer program and a recording medium containing such a computer program.

BRIEF DESCRIPTION OF THE DRAWINGS

For better understanding of the above and other features of the present invention, the preferred embodiments of the invention will be described in greater detail below with reference to the accompanying drawings, in which:

FIGS. 18A and 18B are tables for use in operations carried out in individual modes of FIG. 17;

DETAILED DESCRIPTION OF THE PREFERRED EMBODIMENTS

Description on First Embodiment

Figure 1A:
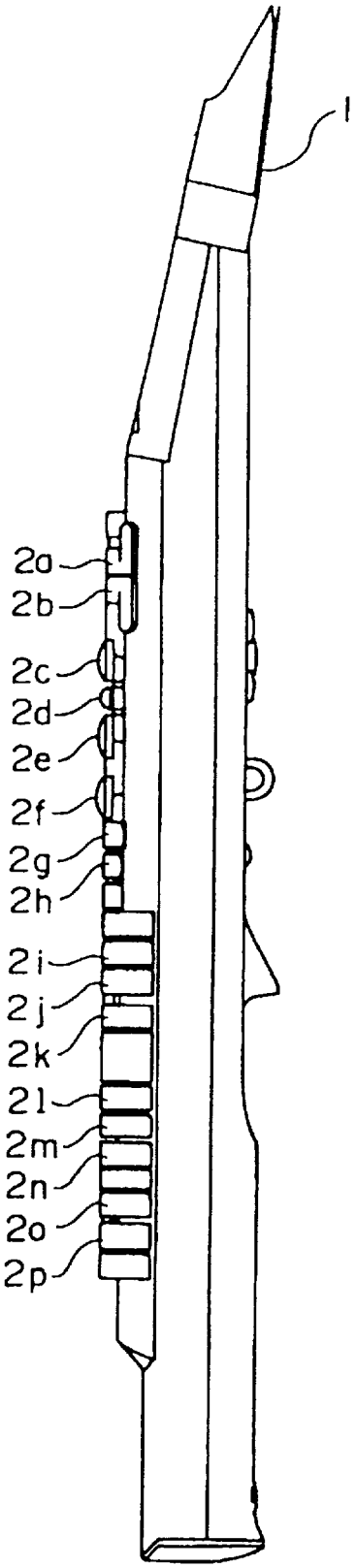
FIGS. 1A and 1B are side and front views illustrating exemplary external arrangements of an electronic wind instrument according to an embodiment of the present invention.
Figure 1B:
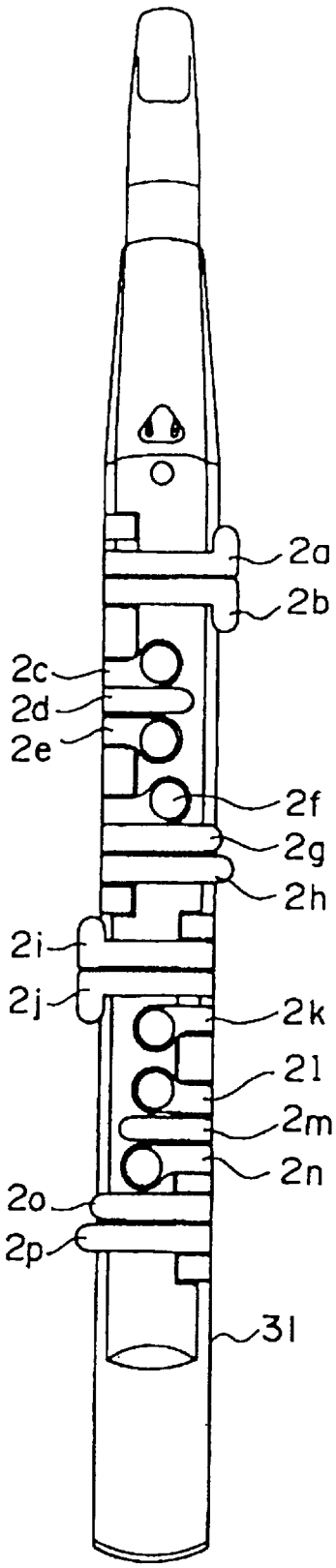

FIGS. 1A and 1B are side and front views illustrating exemplary exterior arrangements of an electronic wind instrument according to a first embodiment of the present invention, where reference numeral 1 represents a mouthpiece that is held in or close to the mouth of a human player for blowing, i.e., sending a current of air or breath through the instrument. Performance keys 2*a* to 2P are provided for depression by the player primarily to designate a desired tone pitch; specifically, the tone pitch is designated on the basis of a combination of respective ON/OFF states of these performance keys by reference to a fingering chart. Tone pitch control executed in the first embodiment will be described in detail below.

Figure 2:
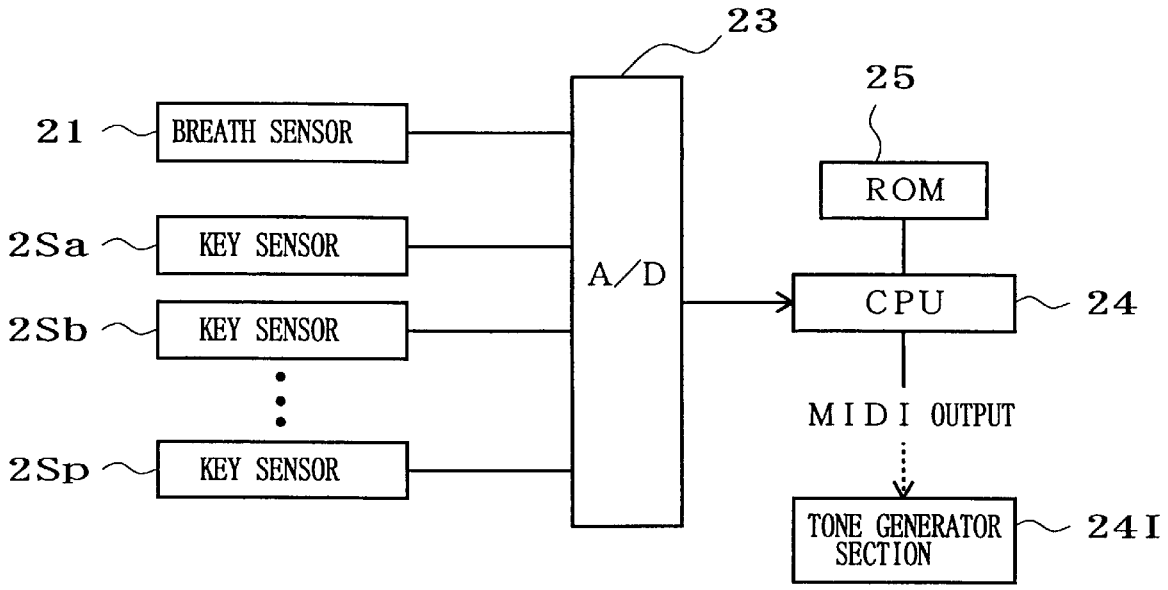
FIG. 2 is a block diagram illustrating exemplary electrical arrangements of the electronic wind instrument shown in FIG. 1.

FIG. 2 is a block diagram illustrating exemplary electrical arrangements of the electronic wind instrument according to the first embodiment. Breath sensor 21 is a sort of mouth operator and detects pressure of each player's blow applied through the mouthpiece 1, and key sensors 2Sa to 2Sp are provided for detecting depression force applied by the player to the corresponding performance keys 2*a* to 2*p*. The above-mentioned mouth operator may also be a sensor for detecting displacement of a lever connected to a false reed relative to a predetermined fixed member.

In this illustrated example, the breath sensor 21 and key sensors 2Sa to 2Sp output signals in analog form, which are converted by an A/D converter 23 into digital representation. The CPU 24 carries out various operations on the basis of programs stored in a ROM 25, as will be later described in detail. According to the present embodiment, the CPU 24 outputs a variety of information complying with the MIDI (Musical Instrument Digital Instrument) standard. In response to MIDI signals from the CPU 24, tones are generated by a tone generator section 241 which is provided integrally with or separately from a body 31 of the electronic wind instrument. Thus, in the following description, the term "tone information generating section" refers to a combination of the ROM 25 and CPU 24, or to a combination of the ROM 25, CPU 24 and tone generator section 241.

Figure 3:
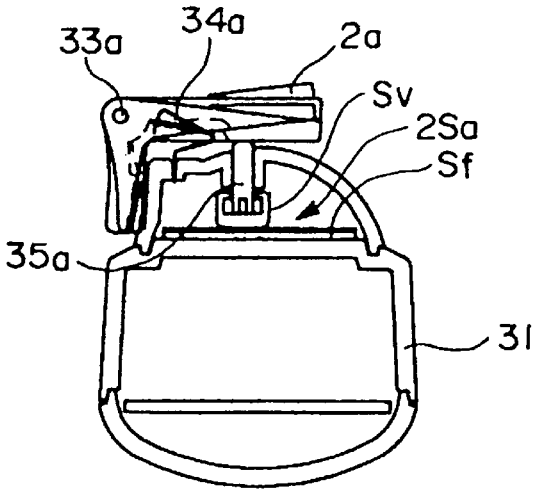
FIG. 3 is a sectional view of the electronic wind instrument according to the embodiment, showing an exemplary structure of one of the performance keys in the embodiment.

FIG. 3 is a sectional view of the electronic wind instrument according to the first embodiment, showing an exemplary detailed structure of the performance keys 2*a* to 2*p*. Note that the performance keys 2*a* to 2*p* are all constructed in the same manner and thus the structure of only one of the performance keys 2*a* will be detailed. As shown, the body 31 of the electronic wind instrument has a plurality of protruding key posts (not shown) each for designating a key, and the L-shaped key 2*a* is pivotably supported, at its bent portion, by a key shaft 33*a*. The body 31 also has a return spring 34*a* urging one end portion of the key 2*a* so that the key 2*a* is held in its original position when no depression force is applied thereto by the player.

Rod 35*a* is supported on the body 31 for vertical movement relative to the body 31, and one end portion of the key 2*a* abuts against the upper end of the rod 35*a*. Thus, human player's depression of the key 2*a* will cause the rod 35*a* to move downward so that the bottom end of the rod 31 depresses the associated key sensor 2Sa. The key sensor 2Sa includes a movable member Sv, made of soft resin (electrically-conductive rubber) containing carbon, fitted on the bottom end of the rod 31, and a fixed member (printed board) Sf having a fixed electric contact printed thereon. The movable member Sv and fixed member Sf of the key sensor 2*a* are disposed in opposed relation in such a manner that the two members Sv and Sf are always in contact with each other or slightly spaced apart from each other only in the absence of player's depression force, with a spacer in the form of an ultrathin polyester film interposed therebetween.

With the above-mentioned arrangement, the key sensor 2Sa presents a high or infinite resistance when no depression force is applied thereto, and decreases the resistance as the depression force is applied. To achieve such resistance variations responsive to the depression force, the fixed member Sf may comprise a pressure-sensitive film with the movable member Sv made of an electric conductive material. Whereas the key sensor is described here as being a pressure-sensitive sensor, it may be any other suitable form of sensor. For example, the movable member Sv may be modified to have a higher carbon content, or electrically-conductive ink may be applied to a portion of the movable member Sv opposed to the fixed member Sf.

Further, in the present embodiment, a detector circuit as described below is used to identify any one of the keys depressed by the player and detect depression force applied thereto.

Figure 4:
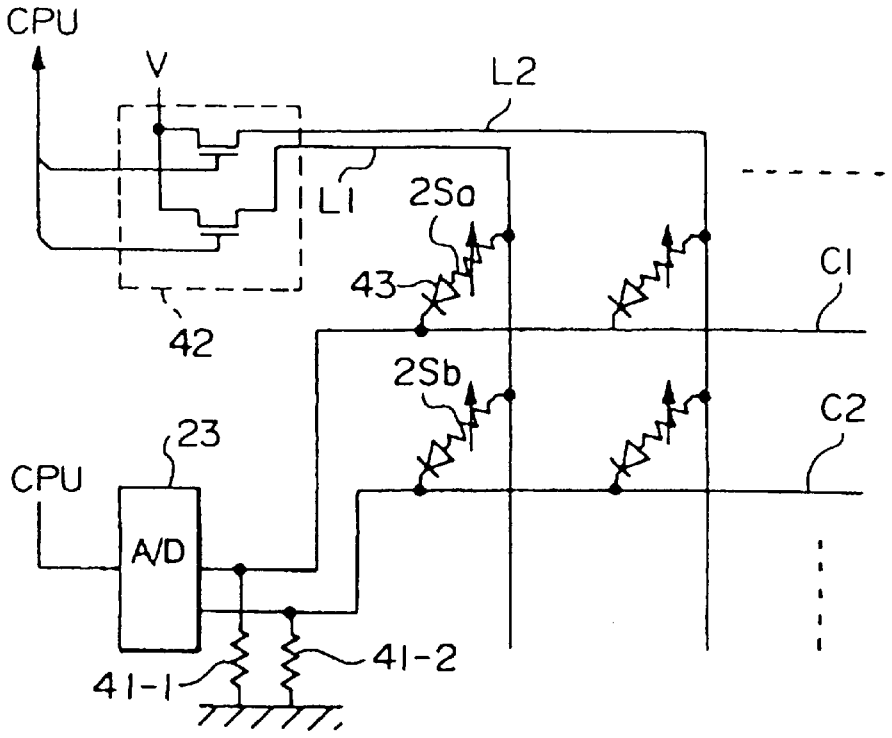
FIG. 4 is a diagram illustrating an exemplary setup of a key-sensor detector circuit employed in the embodiment.

FIG. 4 is a diagram illustrating an exemplary setup of the detector circuit and more particularly showing a detector for detecting respective depression states of the individual keys, where marks of variable resistor represent the key sensors 2Sa, 2Sb, . . . . As shown, the detector circuit includes a matrix comprising column lines L1, L2, . . . and row lines C1, C2, . . . , and each of the key sensors 2Sa, 2Sb, . . . is connected between predetermined points of adjacent column and row lines. The row lines C1, C2, . . . are each connected at one end thereof to the ground via a fixed resistor 41-1, 41-2, . . . , as well as to input of the A/D converter 23. Voltage is sequentially applied via an analog switch 42 to the column lines L1, L2, . . . , and on the basis of ON timing of the lines L1, L2, . . . and output values from the A/D converter 23, the CPU 24 can identify any of the key sensors being depressed and the intensity of the depression force applied to the depressed key sensors.

For example, when the column line L1 is being turned ON, voltage is applied to the key sensor 2Sa and fixed resistor 41-1. As the resistance of the key sensor 2Sa decreases, the voltage to the fixed resistor 41-1 increases and thus the A/D converter 23 outputs an increased value. Conversely, as the resistance of the key sensor 2Sa increases, the voltage to the fixed resistor 41-1 decreases and thus the A/D converter 23 outputs a decreased value. Note that A/D-converted values of player's depression force detected by the key sensors 2Sa to 2Sp will hereinafter be called A/D-converted depression force values and sometimes KP values; thus, reference characters Kpa to Kpp in the following description represent A/D-converted depression force values of the individual keys.

Each diode 43 in the detector circuit of FIG. 4 functions to prevent an electric current from flowing from the row line C to the column line L, because the current flow from the row line C to the column line L would undesirably form a current path to the other key sensors which have not yet arrived at predetermined detection timing and thus prevent the CPU 24 from accurately identifying the depressed key. Although not specifically shown in FIG. 4, the above-mentioned breath sensor 21 is also connected between predetermined points of an pair of adjacent column and row lines of the matrix.

Next, a description will be given about exemplary general behavior of the electronic wind instrument arranged in the above-mentioned manner. First, the fundamental behavior of the instrument will be outlined here in relation to a case where all the performance keys are used to designate a desired pitch.

When the player blows his or her breath into the instrument via the mouthpiece 1, the breath sensor 21 detects pressure of the breath. The breath pressure thus detected by the breath sensor 21 is converted by the A/D converter 23 into digital data, which is then passed to the CPU 24. The A/D-converted breath pressure value, which is shown in the drawings as "BP" for convenience, is expressed by any one of values in the range from "0" to "10".

In accordance with the breath pressure or BP value, the CPU 24 outputs a MIDI message in the following manner. When the breath pressure value has changed from "0" to any one of other values "1" to "10", the CPU 24 determines that the player has blew to initiate generation of a tone and outputs note-on data which includes at least note-on event data and a note number indicative of the name of a note (pitch name) to be sounded. On the other hand, when the breath pressure value has changed from any one of the values "1" to "10" to "0", the CPU 24 determines that the player has stopped blowing to terminate generation of a tone and outputs note-off data which includes at least note-off event data and a note number indicative of the name of a note to be muted or turned off.

Figure 5:
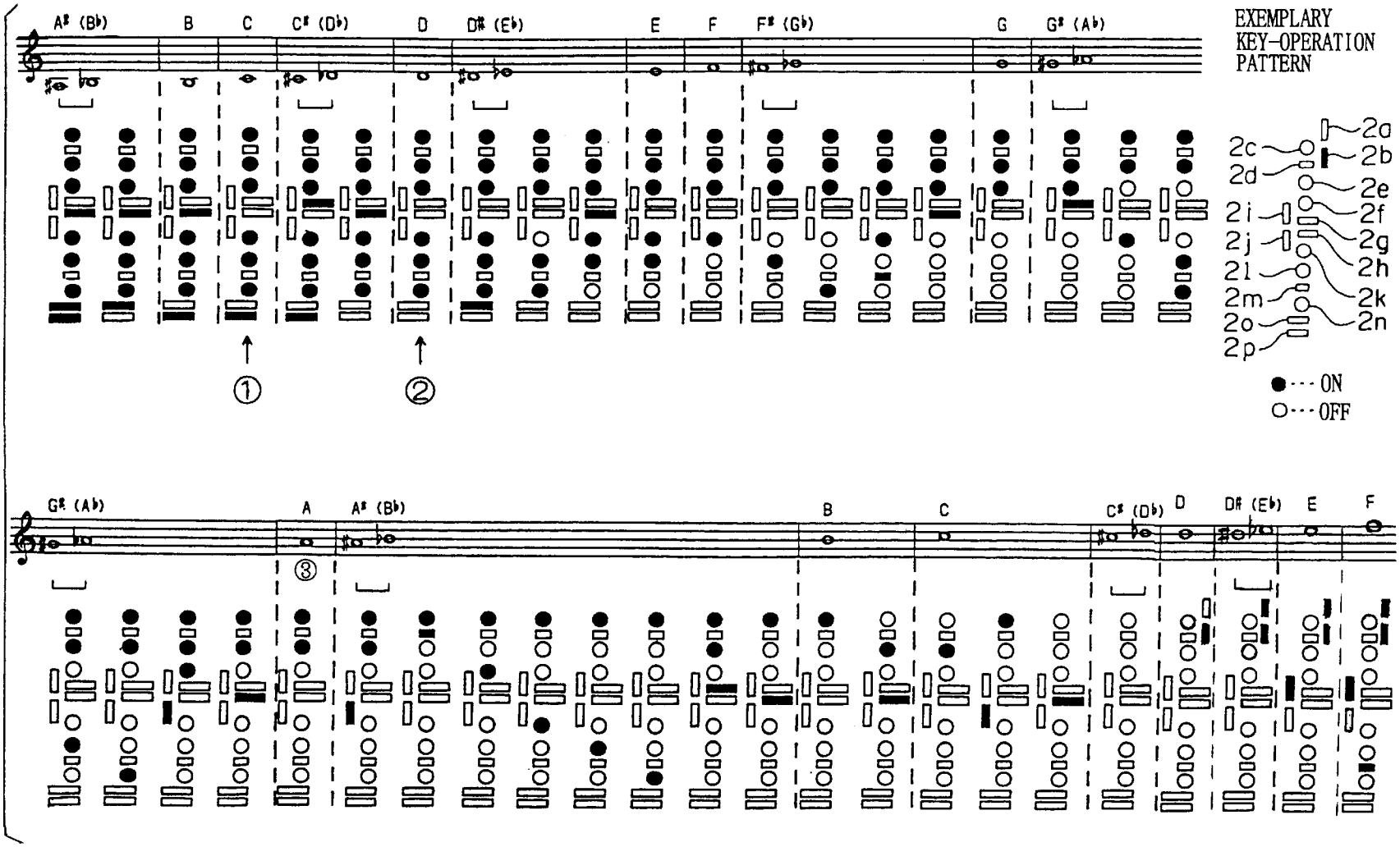
FIG. 5 is a diagram showing an example of a fingering chart employed in the embodiment.

When the output MIDI message from the CPU 24 is note-on data, the note number included therein is determined on the basis of a combination of the respective ON/OFF states of the performance keys 2*a* to 2*p* in accordance with a fingering chart as shown in FIG. 5, as will be described in greater detail below; according to the principle of the present invention, the note number can of course be determined from the operating state of a single key.

In the present embodiment, the breath pressure value is also used as data indicative of the intensity of the player's breath or blow, in accordance with which control may be executed on the tone color, volume, etc. Namely, the CPU 24 constantly detects changes in the breath pressure value, so as to output velocity information indicative of a tone volume and MIDI message designating a tone color (e.g., in the form of control-change data) in response to each detected change in the breath pressure value.

FIG. 5 shows an example of a basic fingering chart employed in the present embodiment, in accordance with which pitch of each tone is determined. In the embodiment, a fingering table TBL representative of relationships between possible combinations of the respective ON/OFF states of the performance keys 2*a* to 2*p* and note numbers are prepared and prestored in the ROM 25. In determining a note number of each performed note, KP value (i.e., A/D-converted depression force value) "0" is treated as presenting the "OFF" state and KP values from "1" to "10" are treated as presenting the "ON" state. The placement or distribution of the keys illustrated in FIG. 5 corresponds to that of the individual performance keys 2*a* to 2*p* of FIG. 1. In FIG. 5, each of the keys to be depressed is denoted in black, while each of the keys to not be depressed is denoted in white. Also, in FIG. 5, each key-placement pattern lacking the performance keys 2*a* and 2*b* shows that these two keys 2*a* and 2*b* are in the OFF or non-depressed state.

In the natural wind instruments, keys corresponding to the performance keys 2*a*, 2*b*, 2*i* and 2*j* are commonly called "trill keys", each of which operates to keep a corresponding hole closed in the absence of depression force exerted thereon and open the hole as it is depressed so that the output tone is caused to become higher in pitch. Thus, when any of the performance keys 2*a*, 2*b*, 2*i* and 2*j* is turned ON, the output tone is caused to become higher in pitch, but when any of the performance keys 2*a*, 2*b*, 2*i* and 2*j* is turned OFF, the output tone is caused to become lower in pitch. By contrast, each of the other keys than the performance keys 2*a*, 2*b*, 2*i* and 2*j* operates to keep a corresponding hole open in the absence of depression force exerted thereon and closes the hole as it is depressed so that the output tone is caused to become lower in pitch. Thus, when any of the other keys than the performance keys 2*a*, 2*b*, 2*i* and 2*j* is turned ON, the output tone is caused to become lower in pitch, but when any of the other keys is turned OFF, the output tone is caused to become higher in pitch.

Now, a description will hereinafter be given about exemplary behavior of the CPU 24.

Figure 6:
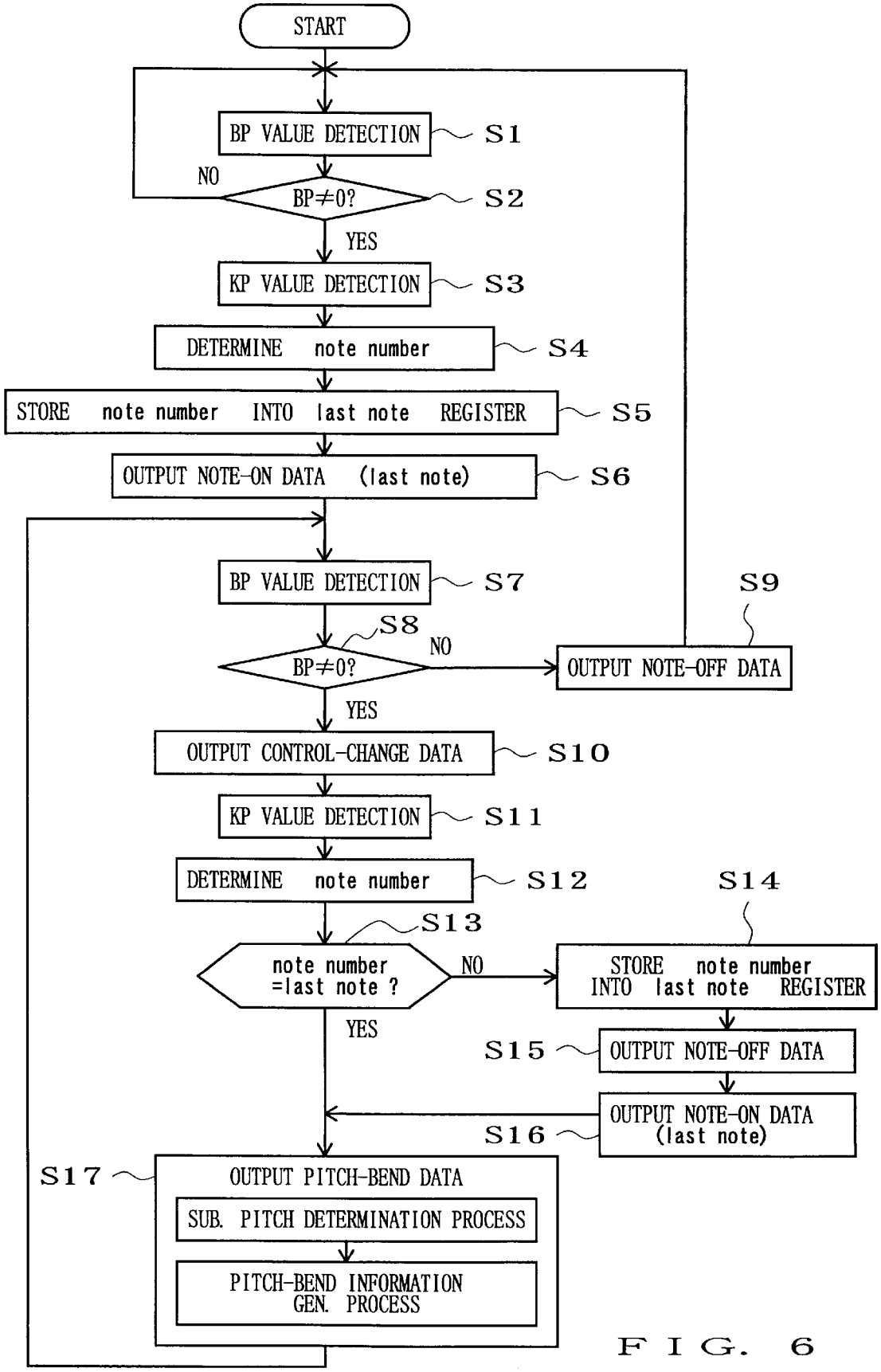
FIG. 6 is a flow chart showing exemplary operations carried out by a CPU in the first embodiment.

FIG. 6 is a flow chart of operations carried out by the CPU 24 in the first embodiment. First, at step S1, the current breath pressure (BP) value is detected on the basis of an output from the breath sensor 21, and then it is determined at next step S2 whether or not the detected breath pressure value is other than "0" (BP≠0). If the the detected breath pressure value is "0" (i.e, if a negative or NO determination is made at step S2), it means that no breath is being blown, and thus the CPU 24 reverts to step S1 in order to repeat the operations of steps S1 and S2 until a breath is blown into the musical instrument.

If the detected breath pressure value is not "0" (i.e., if an affirmative or YES determination is made at step S2), the CPU 24 proceeds to step S3, where the respective ON/OFF states of the individual performance keys 2*a* to 2*p* are detected on the basis of the corresponding A/D-converted depression force values, i.e., KP values (KPa–KPp). In this example, the KP (KPa–KPp) values takes any one of values ranging from "0" to "10", and each of the keys presenting the KP value "0" is treated as "OFF" while the KP values from "1" to "10" are treated as "ON", as note earlier. At next step S4, the performed note is determined by reference to the fingering table TBL on the basis of the detected ON/OFF states of the performance keys 2*a* to 2*p*, and the note number indicative of the thus-determined note is stored into a register for variable "note number".

Then, the value stored in the "note number" register is set into a register for variable "last note" at step S5. After that, on the basis of the stored content of the "last note" register, note-on data instructing a start of generation of a new tone is output in the MIDI format at step S6.

Then, the current breath pressure value is again detected at step S7, after which it is determined at next step S8 whether the detected breath pressure value is other than "0" (BP≠0), i.e., whether the player's blow is still under way. If a negative (NO) determination is made at step S8, i.e., if the player has stopped the blow, note-off data to stop generation of the tone is output in the MIDI format at step S9, and then the CPU 24 loops back to step S1 so as to repeat the operations of steps S1 and S2 until the player executes a new blow. The note-off data includes the note number stored in the "last note" register and note-off event data indicative of a new key-off event.

If the detected breath pressure value is other than "0" (BP≠0), it means that the player's blow is still under way, and thus the CPU 24 proceeds to step S10. At step S10, it is ascertained whether the breath pressure value has changed to a new one, and with an affirmative answer, control-change data corresponding to the new breath pressure value is output in the MIDI format. For example, control-change data is output, at step S10, which instructs control for increasing the tone volume when the new breath pressure value is greater (closer to the maximum value "10") than the last-detected value or decreasing the tone volume when the new breath pressure value is smaller (closer to the value "1") than the last-detected value. If there has been no change in the breath pressure value as ascertained at step S10, the CPU 24 moves on to step S11.

At step S11, the KP (KPa–KPp) values of the individual keys are again read in and checked to detect the respective ON/OFF states of the individual keys. At next step S12, an operation similar to that of step S4 is executed by reference to the fingering table TBL, to determine and store the currently-performed note into the "note number" register. In detecting the ON/OFF state of each of the keys, the key is determined to be in the "OFF" state when the corresponding KP value is "0" and in the "ON" state when the corresponding KP value is within the range from "1" to "10". Namely, even when a specific one of the keys has changed from a fully-depressed state (KP value=10) to a weakly-depressed state and the corresponding KP value has changed from "10" to one of intermediate values ranging from "1" to "9", the specific key is determined to be in the "ON" state at step S12.

At following step S13, a comparison is made between the current stored contents of the "note number" register and the "last note" register. If the current stored contents of the "note number" register and the "last note" register do not match each other, the CPU 24 moves on to step S14; otherwise, the CPU 24 goes to step S17.

More specifically, the CPU 24 branches from step S13 to step S14 upon judging that the tone pitch has changed due to a change in the fingering or finger placement (key operation pattern), i.e., upon judging that there has been a change in the ON/OFF states of the keys with the KP value of at least one of the keys having changed from one of "1" to "10" to "0" or from "0" to one of "1" to "10". At step S14, the current stored content of the "note number" register is set into the "last note" register. After step S14, the CPU 24 goes to step S15 to output a MIDI message containing note-off data, to thereby instruct a stop of tone generation at the last-designated pitch. Then, at step S16, the current stored content of the "last note" register is output, in the MIDI format, as a note number to be newly sounded along with note-on data, as a result of which tone generation at a new pitch is instructed. Once any change has been detected in the fingering or key operation pattern, the CPU 24 instructs turning-OFF or muting of the note having been sounded till the fingering change (step S15), outputs a note number to be sounded after the fingering change (step S16), and instructs sounding of the note number based on the new or changed fingering. In this case, the tone pitch control is executed such that the tone pitch shifts from the last-designated note (i.e., note having been sounded till the fingering change) to the newly-designated note (i.e., note to be sounded after the fingering change) in successive steps rather than continuously as in a slur.

After execution of the above-described tone pitch control, the step loops back to step S7 by way of step S17. At step S17, control is made of a pitch-bend amount when this step is taken directly after step S13, but no such pitch-bend control is effected when this step is taken by way of steps S14, S15 and S16.

If, on the other hand, the current stored contents of the "note number" register and the "last note" register match each other as determined at step S13 (YES), particular tone pitch control is normally unnecessary now that no change has been detected in the designated pitch; however, the present embodiment is arranged to execute or to not execute tone pitch control as the case may be. Specifically, in a first case where the KP values for all the currently-depressed keys are "10", no instruction to change the tone pitch is issued.

The second case will be where continuous tone pitch control is to be effected, as in a slur, in response to a change in the fingering, such as when the KP values for some or all of the currently-depressed keys are in the range from "1" to "9", i.e., intermediate values. In this case, although all of the keys are determined to be in the ON state, it can be presumed, from the presence of at least one key presenting an intermediate KP value, that the player is releasing the key little by little in order to effect a slur. Thus, the present embodiment is arranged to execute pitch-bend control so as to achieve a pitch variation similar to a slur. The following paragraphs detail the pitch-bend control executed in the present embodiment.

Each of the keys presenting an intermediate KP value (in the range from "1" to "9") can be said to be a key which has just started being released from the fully-depressed state. Thus, to know a note that will be ultimately reached as a result of changing the pitch via a slur, the CPU 24 determines a new tone number, by reference to the table in the ROM 25, by treating or assuming the keys presenting the KP values "0" and "1–9" as being in the OFF state and the keys presenting the KP value "10" as being in the ON state (assumptive ON/OFF states). Namely, the note number indicative of the ultimately-reached note as a result of the slur is determined by judging each of the keys with a decreasing depression force to be a key that is released via the slur performance. The thus-determined note number is stored into the register for variable "new note number". (This process corresponds to a subsidiary pitch determination process.)

Then, to determine a range of the pitch bend, a difference is calculated between the current note number (i.e., the note number having been sounded till the slur) stored in the "last note" register and the note number to be sounded after the slur stored in the "new note number" register. The calculated difference represents a difference between tone pitches immediately before and after the slur, i.e., a range over which the pitch bend is to be effected. Then, interpolation operations are executed over the determined pitch-bend range to thereby determine a pitch bend amount. (This process corresponds to a pitch-bend information generation process.)

Specifically, the pitch-bend amount is determined in the embodiment by interpolating the pitch difference between the "last note number" and the "new note number" in accordance with the KP value. For example, the pitch-bend amount may be determined by linear interpolation or by a function using the KP value as a parameter, although the present embodiment is described here as employing the linear interpolation. Such a function may be prestored in the ROM 25.

Figure 7:
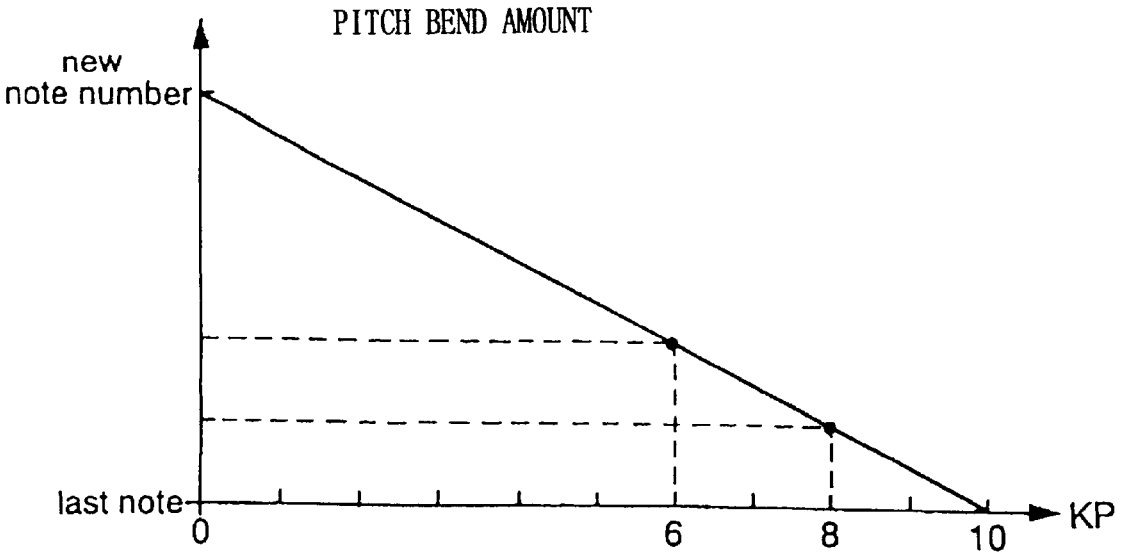
FIG. 7 is a graph illustrating relationship between key sensor outputs and pitch-bend amounts in the first embodiment.

FIG. 7 is a graph illustrating relationship between the KP value and the pitch-bend amount (pitch shift amount). In the graph, it is shown that greater KP values result in the tone pitch being bent closer to the "last note number" while smaller KP values result in the tone pitch being bent closer to the "new note number". Whereas FIG. 7 shows an example employing a linear interpolation, the interpolation may be an optional nonlinear interpolation or one using a function.

The operations of the above steps will be more fully described in relation to a case where only one of the keys presents an intermediate KP value. Let's assume here that a note number "60" (pitch name "do": see ① in FIG. 5) has been written into the "last note" register through note detection at a particular time point and the KP values of the key sensors turned ON then are all "10". If the KP value of one of the performance keys 2*p* corresponding to the lowest finger is "8" in the detection of step S11, then the CPU 24 determines that the performance key 2*p* is still in the ON state and obtains a note number "60" from the fingering table to store the obtained note number into the "note number" register at step S12.

Because the number currently stored in the "note number" register is "60" (pitch name "do": see ① in FIG. 5), the current stored content of the "last note" register matches that of the "note number" register, and thus an affirmative (YES) determination is made at step S13, so that control or the CPU 24 proceeds to step S17. Then, at step S17, the performance key 2*p* is determined to be in the OFF state because the KP value thereof is an intermediate value (KPp=8), and a new note number "62" (pitch name "re": see ② in FIG. 5) is obtained, which is then stored into the "new note number" register. Here, a pitch-bend range "2" (200 cents) is determined by subtracting the last note number "60" from the new note number "62". Further, linear interpolation is carried out on the basis of the KP value (=8) (see FIG. 7), and the resultant interpolated value is output as a pitch-bend amount. As a consequence, the tone is shifted from the pitch name "do" to another pitch 40 cents (200×1/5) higher. After that, control loops back to step S7.

Assume here that the player then further reduces the depression force on the performance key 2*p* until the KP value of the key reaches a value "6". Because the KP value of the performance key 2*p* is in the intermediate value range (KPp=6) in this case as well, a note number "60" (pitch name "do": see ① in FIG. 5) is again stored into the "note number" register at step S12. Thus, an affirmative (YES) determination is made at step S13, so that control proceeds to step S17. Then, at step S17, the performance key 2*p* is determined to be in the OFF state because the KP value thereof is in the intermediate value range (KPp=6), and a new note number "62" (pitch name "re": see ② in FIG. 5) is obtained, which is stored into the "new note number" register. This time, whereas the bend range remains unchanged from "200", the linear interpolation yields an increased pitch-bend amount (see FIG. 7) because the KP value has changed to "6", so that generation of a tone 80 cents (200×3/5) higher than the pitch name "do" is instructed.

The above-described operations at steps S7 to S17 of FIG. 6 are repeated as long as the player continues the slur performance. As a consequence, the generated tone is gradually raised smoothly in pitch and pitch control corresponding to the slur is executed, until the player completely releases the performance key 20 to effect the finger placement or key operation for the pitch name "re".

Figure 8:
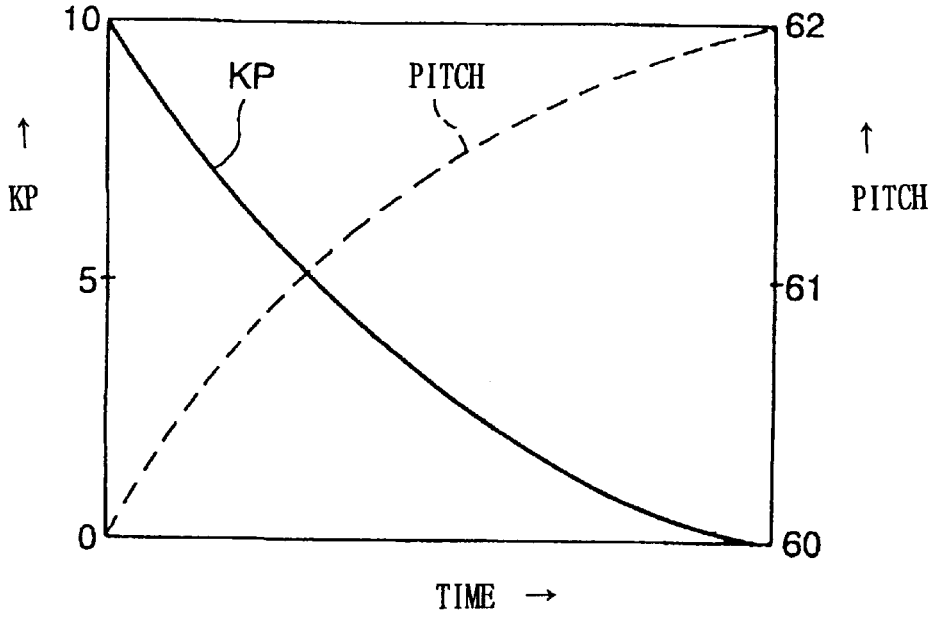
FIG. 8 is a graph illustrating relationship between time-variation of KP (A/D-converted depression force) values and pitch variation corresponding thereto.

FIG. 8 is a graph illustrating relationship between variations in the KP value and pitch when the depression force on the performance key 2*p* is gradually reduced over time from the maximum, from which it is seen that the smaller player's depression force, the higher pitch the tone is bent to and also that the pitch variation corresponds to the variation in the KP value. As a consequence, the player is allowed to achieve a desired slur characteristic by properly adjusting the force of the finger in releasing the key.

The above description has been given in relation to the case where only one of the keys presents an intermediate KP value. In cases where a plurality of the performance keys present intermediate KP values, however, the following operation may be carried out at step S17. First, similarly to the above-described, a note number is determined from the fingering table by determining all of the performance keys, presenting KP values "1" to "9", to be in the OFF state, and a difference between the determined note number and the last note number is determined as a pitch bend range. Next, pitch-bend information is output, but in this case a shift amount is determined on the basis of a plurality of the intermediate KP values, such as in accordance with the average of these KP values, a function using the average as a parameter or the greatest or smallest of these intermediate KP values. Also, slur control paying attention to only a particular one of the keys may be executed by determining only one of the keys, presenting the greatest or smallest of these KP values, to be in the OFF state.

Briefly stated, the first embodiment of the present invention comprises: a depression-state detecting means (steps S3 and S11 executed by the CPU 24 and the fingering table TBL in the ROM 25) for detecting the respective depression states of the individual pitch-designating keys; a pitch determining means (steps S4 and S12 executed by the CPU 24) for detecting the ON/OFF states of the keys on the basis of values representative of their detected depression states to determine the current tone pitch; a next-pitch determining means (process executed by CPU 24) for determining a next tone pitch on the assumption that those of the keys, presenting the depression state values smaller than a predetermined value, are in the OFF state irrespective of the determination by the pitch determining means; and a slur control means (process executed by the CPU 24) for generating pitch-bend information for smoothly varying the tone pitch toward the next one determined by the next-pitch determining means.

Thus, the first embodiment can execute a slur performance via cooperation between the next-pitch determining means and the slur control means and, of course, a normal (non-slur) performance based on the determination by the pitch determining means as well. Further, the first embodiment can provide a slur control effect paying attention to a particular one of the keys, by determining the pitch variation amount on the basis of the detected depression state value of a predetermined one of the keys (such as the one presenting the greatest or smallest depression state value).

The condition where the sensor output value KP is a predetermined intermediate value may be assumed to be a change from the OFF to ON state, rather than a change from the ON to OFF state. For example, in a main pitch determination operation, each of the KP values in the range from "0" to "3" may be determined as indicating the OFF state and each of the KP values in the range from "4" to "10" may be determined as indicating the ON state. In a subsidiary pitch determination operation, the KP values "1" to "3" may be used as predetermined intermediate values for inverting the OFF state to the ON state and the KP values "4" to "9" may be used as predetermined intermediate values for inverting the ON state to the OFF state.

The following paragraphs describe modifications of the above-described first embodiment of the present invention.

Player's depression force on a particular key would sometimes vary, without being noticed by the player, due to relations with other fingers, and such an unconscious depression force variation could result in an appreciable pitch variation that should not be tolerated. Thus, the embodiment may be modified in such a manner that the slur control is effected only when detection has been made of a KP value implying player's conscious variation. Specifically, whereas the slur control at step S17 in the first embodiment has been described as calculating a new note number by determining the keys, presenting KP values "0" and "1 to 9", to be in the OFF state, the keys presenting KP values "0" and "1" to "7", for example, may be determined to be in the OFF state and the other keys presenting KP values "8" to "10" may be determined to be in the ON state. Dead zones may be applied to the threshold value. For example, in a situation where the KP values "0" and "1" are set to represent OFF keys with KP values "6" to "10" set to represent ON keys, the keys presenting KP values from "2" to "5" may be determined to be in an inverted state from the last state (i.e., OFF if the last state is ON, or ON if the last state is OFF).

When two or more of the keys have been detected as presenting KP values in the range of "1" to "9", the slur control may be effected only if a difference between the new note number and the last note equals a whole tone (=200 cents) or a semitone (=100 cents). In this case, the KP value used to determine a shift amount to be included in pitch-bend information may be the greatest or smallest or average of the KP values for all the keys. Thus, when there is too great a pitch difference, this modification carries out ordinary step-by-step pitch control, judging that player's depression force on a particular key is being lowered due to relations with or influence from other fingers and the player is not actually executing a slur performance. As stated above, the slur control may be carried out using only one or some of the keys presenting intermediate KP values.

When only one of the keys presents an intermediate KP value in the range of "1" to "9", the difference between the "new note number" and the "last note" often equals a whole tone or semitone. Thus, the slur control may be executed only when there is only one key presenting an intermediate KP value in the range of "1" to "9".

These modifications can avoid erroneous behavior that would lead to unnatural pitch variations when the player is unconsciously changing his or her depression force. For example, when the force of player's intended depression on one key is diminishing due to relations with other fingers, it is possible to prevent sounding of an unintended tone pitch.

Note that each desired note may be entered via such an arrangement where notes correspond to the keys on a one-to-one basis, rather than on the basis of the ON/OFF states of a plurality of keys as in natural wind instruments. In such a case, an interpolation operation may be performed between two successive notes to provide an intermediate pitch, by using one of the keys depressed earlier as the current note and the other key depressed, with an intermediate-level depression force, additionally after the one key as a target note.

Description on Second Embodiment

The second embodiment of the present invention is characterized by providing key depression information of the performance keys 2*a* to 2*p* as after-touch information. The second embodiment may employ the same hardware setup as in the above-described first embodiment.

Figure 9:
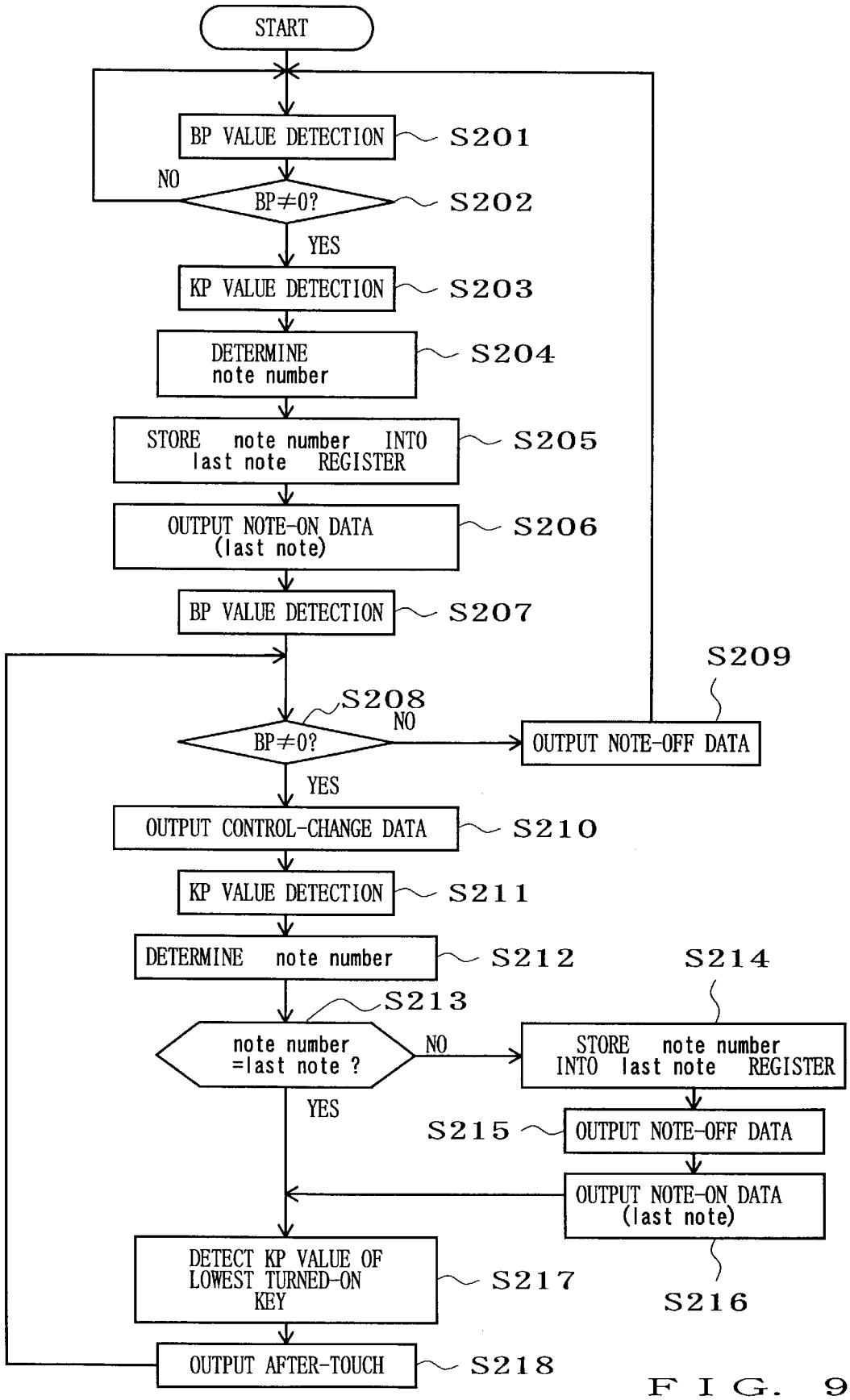
FIG. 9 is a flow chart illustrating various operations carried out by the CPU in a second embodiment of the present invention.

FIG. 9 is a flow chart illustrating various operations carried out by the CPU 24 in the second embodiment. The basic behavior of the CPU 24 is the same as in the first embodiment in that the tone pitch control is executed in accordance with a combination of the respective ON/OFF states of the performance keys. Specifically, operations of steps S201 to S213 are the same as those of steps S1 to S13 in the first embodiment (FIG. 6) and will not be described here to avoid unnecessary duplication.

When a change has been detected in the combination of the respective ON/OFF states of the performance keys, the CPU 24 branches to step S214 now that the variable "note number" is not the same as the variable "last note". The current stored content in the "note number" register is set into the "last note" register at step S214, and note-off data is output at next step S215. At next step S216, the current stored content of the "last note" register is output as a note number along with note-on data, and then the CPU 24 proceeds to step S217. When, on the other hand, no change has been detected in the combination of the respective ON/OFF states of the performance keys and thus the variable "note number" is the same as the variable "last note", the CPU 24 goes directly from step S213 to step S217, and no pitch variation will occur in this case.

According to the second embodiment, after-touch control is carried out at steps S217 and S218 irrespective of whether or not the tone pitch has been varied. The after-touch control employed here is intended to vary a pressure value contained in after-touch information based on the MIDI standard; to this end, the CPU 24 first detects a KP value of one of the currently depressed or turned-ON performance keys which is at the lowest location and then determines a pressure value on the basis of the detected KP value.

Namely, at step S217, the CPU 24 detects one of the currently turned-ON performance keys which is at the lowest location among the keys. Because the positional relationship among the keys is known, the lowest-located key may be detected from that relationship. More specifically, because the keys are scanned in a predetermined order and it is known at which timing the KP value of each of the keys is output, there is some correspondency between the KP value output timing and the key locations, from which it is possible to detect the lowest-located key. The key scan order may be either from the lowest-located key to the highest-located key or from the highest-located key to the lowest-located key. Then, the KP value of the lowest-located key is stored into a register for variable "PP" (not shown) at step S217.

Then, at step S218, a pressure value is determined, on the basis of the stored value in the "PP" register, to output after-touch information, after which the CPU 24 loops back to step S208. In this way, the operations of steps S208, S210 to S218 will be repeated until the breath pressure value becomes zero. As a consequence, an after-touch effect, such as a vibrato, can be imparted to the tone by adjusting the depression force on the lowest-located "ON" key.

The reason why the lowest-located key of all the currently depressed keys is used as an after-touch operator in the embodiment is that the lowest-located key is normally the easiest to operate.

The second embodiment of the invention may be modified as follows. Whereas the second embodiment has been described as determining a pressure value, to be included in the after-touch information, on the basis of the KP value of the lowest-located "ON" key, the pressure value may be determined on the basis of the KP value of any other one (e.g., the highest-located) of the currently depressed keys, or an average of the KP values of all the currently depressed keys may be used as the pressure value. Further, tone control carried out in the present embodiment may be any form of tone control, such as that of pitch, color or volume. Furthermore, the above-mentioned after-touch control at steps S217 and S218 may be inserted before the slur control at step S17 of the first embodiment (FIG. 6) so that the slur control and after-touch control are effected simultaneously.

Description on Third Embodiment

The third embodiment of the present invention is characterized by capability to change the function of the performance keys 2*a* and 2*b*. The two keys 2*a* and 2*b* are pitch-designating keys that are called "high trill keys" in natural instruments such as saxophone, and these keys are frequently used in some music genres (e.g., jazz performance) and seldom used in others (e.g., classical music performance). Therefore, in cases where the performance keys 2*a* and 2*b* are not used for tone pitch designation, they may be used for tone control, such as tone color change, to enhance performance expression.

Figure 10A:
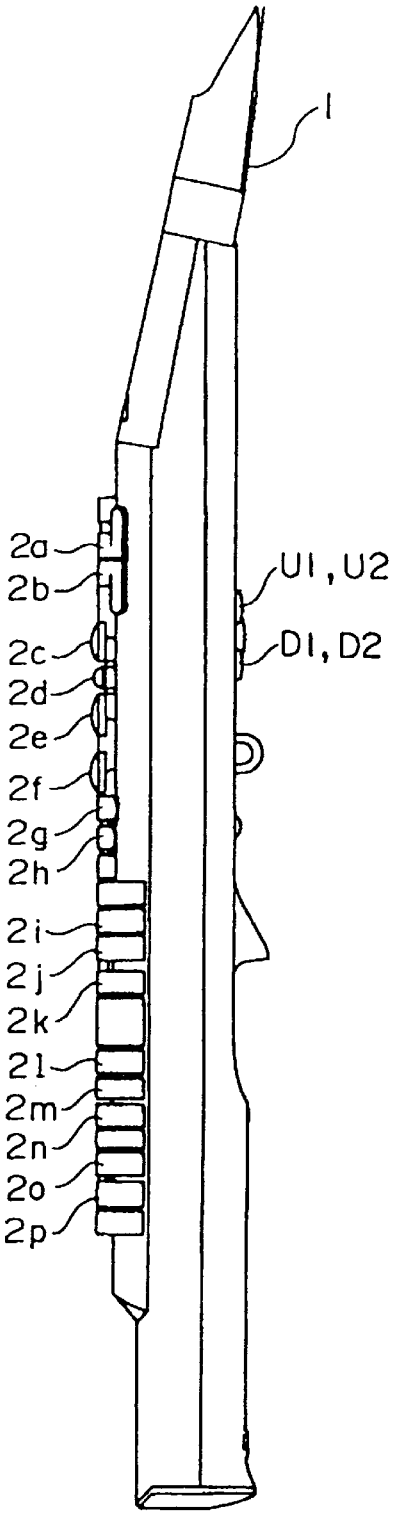
FIGS. 10A, 10B and 10C are side and front views illustrating exemplary external arrangements of an electronic wind instrument according to a third embodiment of the present invention.
Figure 10B:
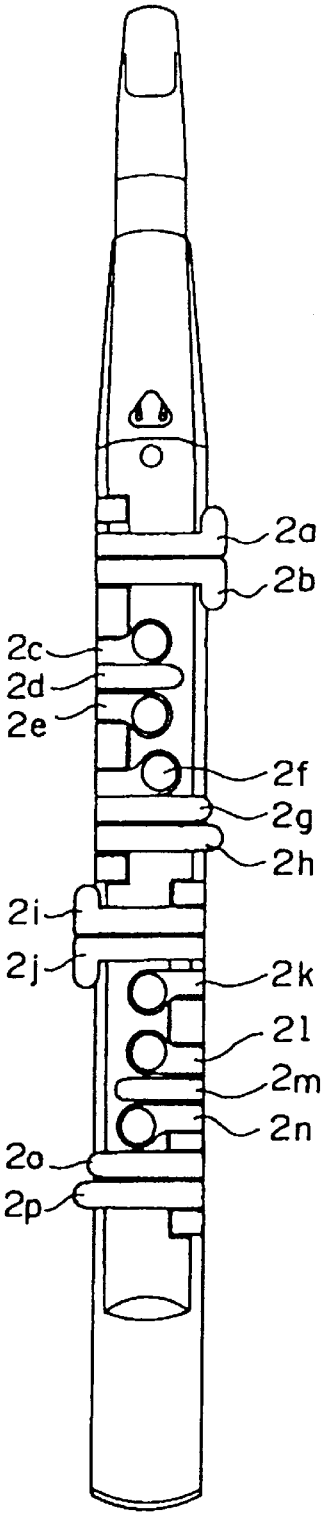
Figure 10C:
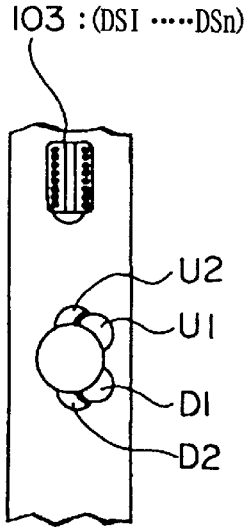

FIGS. 10A, 10B and 10C are side, front and rear views illustrating exemplary external arrangements of the electronic wind instrument according to the third embodiment of the present invention. The mouthpiece 1 and performance keys 2*c* to 2*p* are the same as those in the first embodiment of FIG. 1 and will not be described here to avoid unnecessary duplication.

DIP switch unit 103, which is for setting various conditions in the electronic wind instrument, is employed here to switch the use or function of each of the performance keys 2*a* and 2*b* between tone-controlling and pitch-designating modes. Thus, in this case, a desired one of the pitch-designating function (i.e., function as a high trill key) and the tone-controlling function (i.e., function as a control key) is selected via the DIP switch unit 103.

In the case where the performance keys 2*a* and 2*b* are used as high trill keys, all the keys 2*a* to 2*p* on the instrument can be called pitch-designating keys; however, in the case where the performance keys 2*a* and 2*b* are used to generate a tone control parameter rather than to designate a tone pitch, these two keys 2*a* and 2*b* can be called special keys and one of the switches (SWs) of the DIP switch unit 103 which is used to convert the keys 2*a* and 2*b* into such special keys can be called a mode designating means for setting the keys as tone controlling keys functionally distinct from the other keys. The DIP switch unit 103 includes "n" switches (DS1 to DSn), and the first switch element DS1 is used in the present embodiment to select the function of the performance keys 2*a* and 2*b*.

Further, in the figures, reference characters U1, U2, D1 and D2 represent octave keys, which can be depressed to vary the pitch of a tone by the octave. These octave keys U1, U2, D1 and D2 may be of any desired form, such as pressure-sensitive switches, mechanical contact switches or optical switches, as long as their respective ON/OFF states can be detected individually.

In the third embodiment of the present invention, the CPU 24 detects the respective ON/OFF states of the individual switches of the unit 103 to thereby select either of the following two processes.

[Process when performance keys 2*a* and 2*b* are assigned to pitch designation]

In the case where the performance keys 2*a* and 2*b* are assigned to pitch designation, the pitch designation is effected by a combination of the ON/OFF states of the performance keys as in the first embodiment. Specifically, the pitch designation is carried out on the basis of all the KP values (KPa to KPp) by reference to a fingering chart similar to that of the first embodiment (FIG. 5).

[Process when performance keys 2*a* and 2*b* are assigned to tone control]

Figure 11:
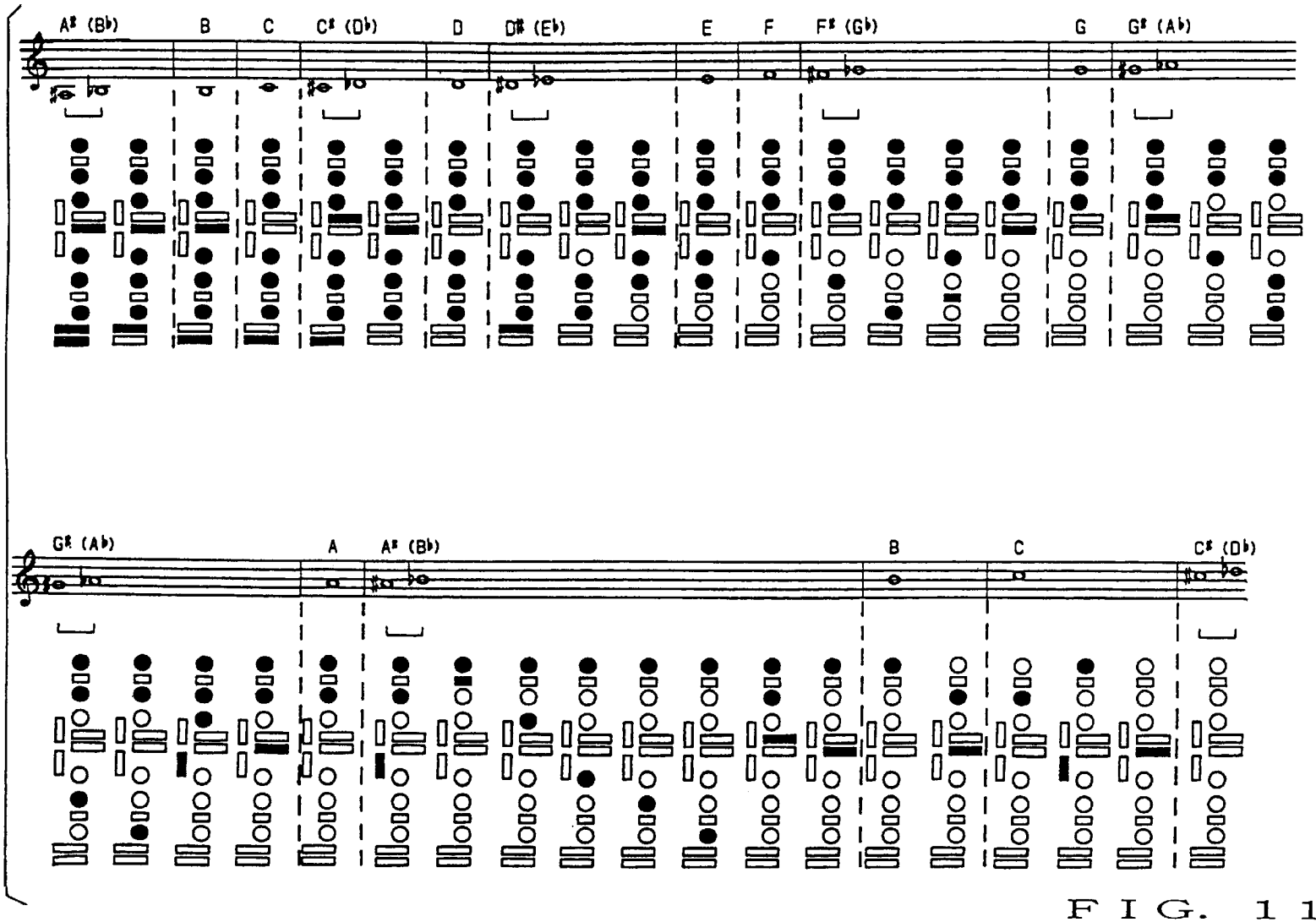
FIG. 11 is a fingering chart for use in a mode where the performance keys are used for tone control.

In the case where the performance keys 2*a* and 2*b* are assigned to control of tone pitch, color and volume, KP values of the keys 2*a* and 2*b* (KPa and KPb) are disregarded in effecting the pitch designation based on a combination of the ON/OFF states of the performance keys, and these keys 2*a* and 2*b* are treated as "OFF". FIG. 11 shows a fingering chart for use in such a case where the performance keys 2*a* and 2*b* are assigned to tone control. In this case, the CPU 24 outputs tone control data, such as control change or program change information, depending on the KP values of the performance keys 2*a* and 2*b*. Namely, in this case, tone control data is determined by some of the keys being monitored for depression force, and a tone pitch is determined by the other keys.

Now, the above-mentioned processes will be detailed with reference to the flow charts of FIGS. 12 and 13. First, a DIP switch setting operation is executed at step S301, where, first of all, the first switch DS1 of the DIP switch unit 103 is set to the ON or OFF state. If the first switch DS1 is set ON, the performance keys 2*a* and 2*b* will be used as high trill keys for music performance, while if the first switch DS1 is set OFF, the performance keys 2*a* and 2*b* will be used as tone controlling keys.

Figure 14:
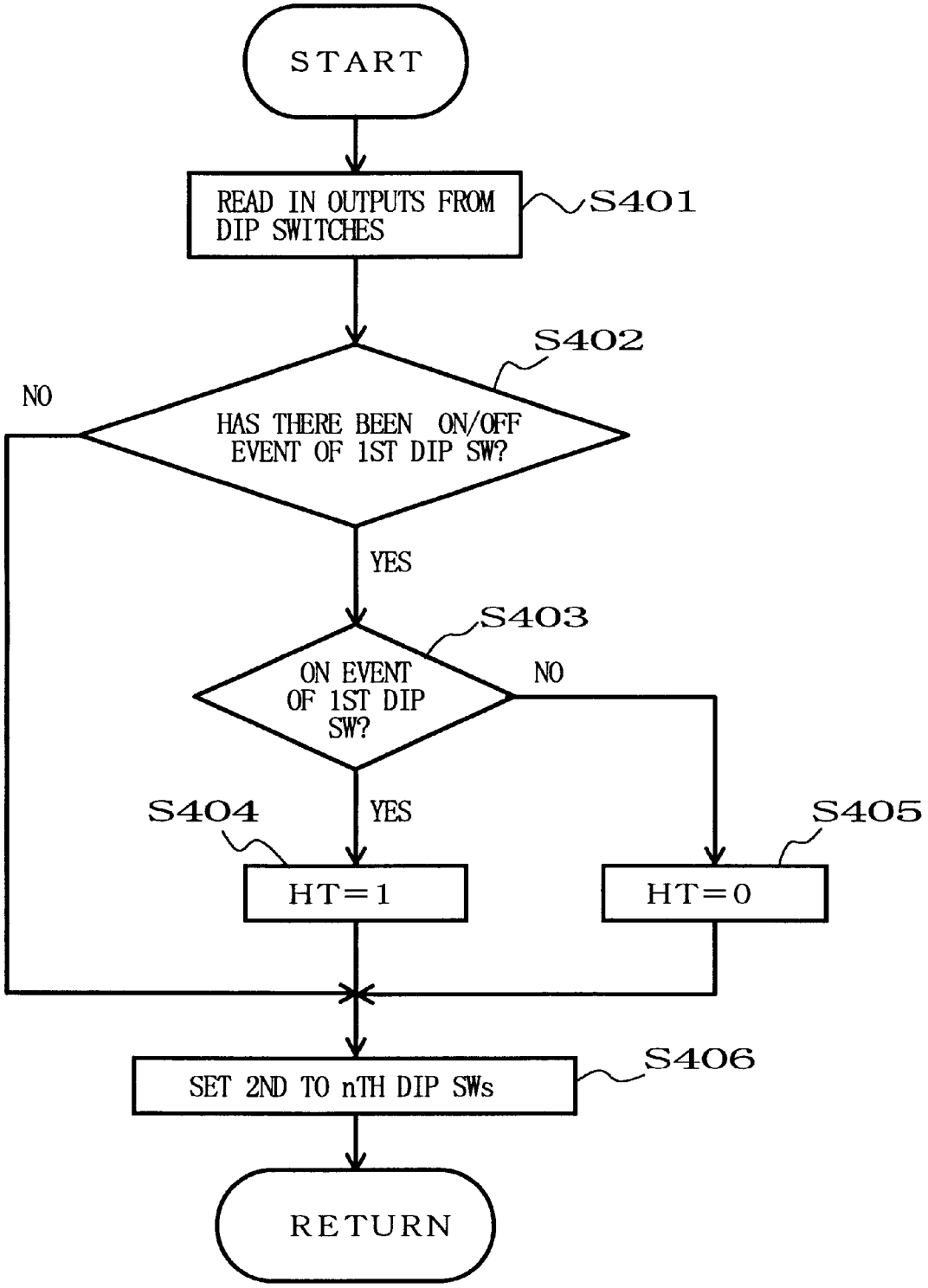
FIG. 14 is a flow chart of a DIP switch setting operation carried out in the third embodiment.

FIG. 14 is a detailed flow chart of the DIP switch setting operation of step S301. First, outputs from the DIP switch unit 103 are received and read in at step S401, and then a determination is made at step S402 as to whether there has been an ON/OFF event of the first switch DS1. If answered in the affirmative (YES) at step S402, it is further determined at step S403 whether the first switch DS1 is ON. If the first switch DS1 is ON as determined at step S403, a value "1" is set into a flag HT at step S404, but if the first switch DS1 is OFF, "0" is set into the flag HT at step S405. The flag set at the value "1" (switch SD1=ON) indicates that the performance keys 2*a* and 2*b* are being assigned to the tone control, while the flag set at the value "0" (switch SD1=OFF) indicates that the performance keys 2*a* and 2*b* are being assigned to the tone control.

After setting the flag HT (step S404 or S405) or if there has been no ON/OFF event of the first switch DS1 as determined at step S402, the CPU 24 proceeds to step S406 to set respective states of the 2nd to nth switches DS2 to DSn each of which is used, for example, to designate any one of functions allocated thereto. The setting operation of these switches is carried out, in a similar manner to steps S401 to S405 above, using different flags associated therewith.

Figure 12:
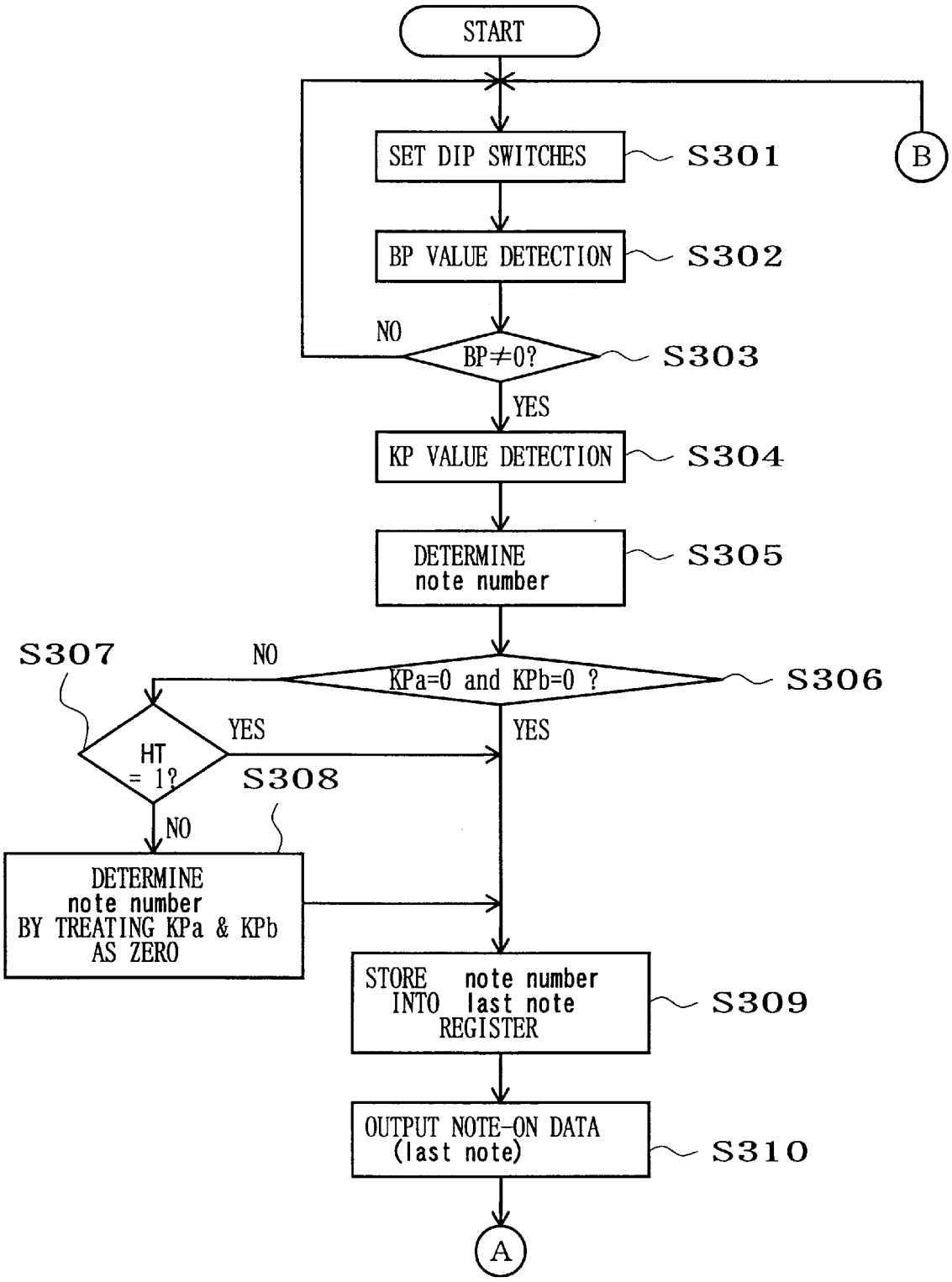
FIG. 12 is a flow chart illustrating part of various operations carried out by the CPU in the third embodiment of the present invention.
Figure 13:
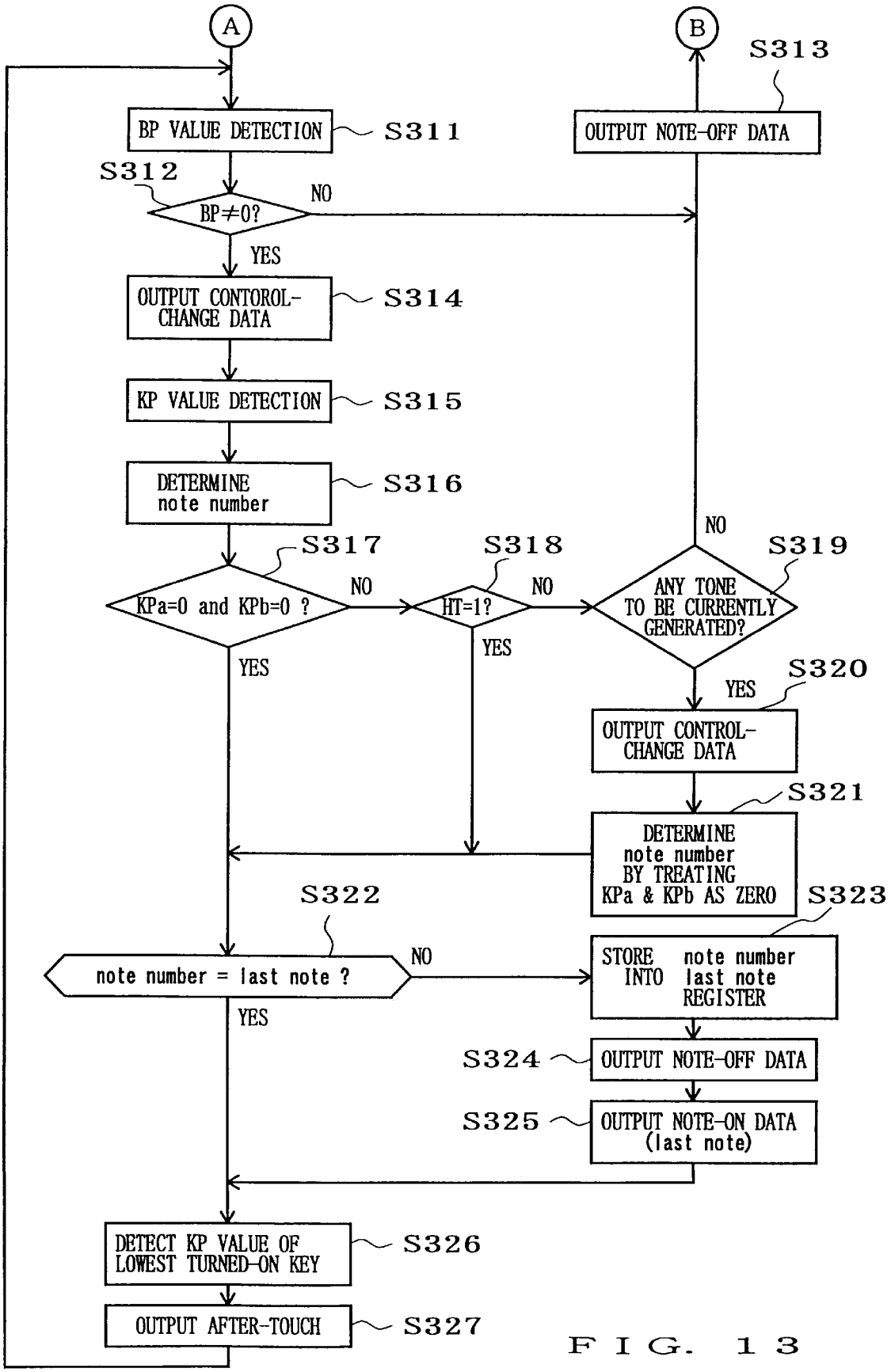
FIG. 13 is a flow chart illustrating the remaining part of the operations carried out by the CPU in the third embodiment of the present invention.

Referring back to the flow chart FIG. 12, the CPU 24 detects the current breath pressure (BP) value at step S302 after the DIP switch setting operation of step S301. It is then determined at next step S303 whether the detected breath pressure value is other than "0" (BP≠0) or not. If the detected breath pressure value is "0" (NO), the CPU 24 loops back to step S301. If, on the other hand, the detected breath pressure value is not "0", the CPU 24 sequentially detects respective KP values of all the keys KPa to KPp at step S304, and it then determines a performed note number from the respective ON/OFF states of the keys by reference to the fingering table in the ROM 25 (fingering chart of FIG. 5) and stores the determined note number into the "note number" register at step S305.

At next step S306, it is determined whether both of the performance keys 2*a* and 2*b* are not currently being operated, i.e., whether the values KPa and KPb are "0". If both of the performance keys 2*a* and 2*b* are not currently being operated as determined at step S306, they will have no particular effect on the note number determined at step S305, and the CPU 24 proceeds to step S309. If either or both of the performance keys 2*a* and 2*b* are currently being operated, the CPU 24 branches to step S307 to check the flag HT because tone information differs depending on whether the performance keys 2*a* and 2*b* are being assigned to the pitch designation or to the tone control. If the flag HT is at "1", this means that the performance keys 2*a* and 2*b* are being assigned to the pitch designation and they will have no particular effect on the note number determined at step S305, so that the CPU 24 goes to step S309.

If, on the other hand, the flag HT is at "0", this means that the performance keys 2*a* and 2*b* are being assigned to the tone control and thus it is not proper to output the note number having been determined by judging the performance keys 2*a* and 2*b* to be in the ON state. So, a new note number (NN) to be sounded is derived by treating the KP values of these keys 2*a* and 2*b* (KPa and KPb) as "0" and then stored into the "note number" register at step S308. Specifically, the new note number (NN) is derived by again referring to the fingering table on the basis of the ON/OFF states of the keys other than the keys 2*a* and 2*b*. Once the note number to be sounded has been determined in this way, the note number is stored in the "last note" register at step S309 and then note-on data is issued at step S310 to output the stored content of the "last note" register as a note number.

After that, the CPU 24 moves on to step S311 to again detect the breath pressure value, and makes a determination at step S312 as to whether the detected breath pressure value is other than "0" (BP≠0). If the detected breath pressure value is "0", the CPU 24 issues note-off data at step S313 and then reverts to step S301. Namely, once the player stops blowing, note-off data is issued to terminate generation of the tone signal at step S313, and the CPU 24 reverts to step S301 to proceed with next performance state detection.

If, on the other hand, the detected breath pressure value is not "0" as determined at step S312, control-change data corresponding to the detected breath pressure value is issued at step S314. For example, the CPU 24 outputs control-change data, including a set of data indicative of the type of the subject control (i.e., tone volume) and the tone volume level, such that a greater breath pressure (closer to the maximum value "10") results in a higher tone volume and a smaller breath pressure (closer to the value "1") results in a lower tone volume.

After that, the CPU 24 again detects respective KP values of all the keys KPa to KPp at step S315, and it then determines a performed note number on the basis of the respective ON/OFF states of the keys by reference to the fingering chart and stores the determined note number into the "note number" register at step S316. At next step S317, it is determined whether both of the performance keys 2*a* and 2*b* are not currently being operated, i.e., whether the values KPa and KPb are "0", similarly to step S306 above. If both of the performance keys 2*a* and 2*b* are not currently being operated as determined at step S317, they will have no particular effect on the note number determined at step S316, and the CPU 24 proceeds to step S322. If either or both of the performance keys 2*a* and 2*b* are being currently operated, the CPU 24 branches to step S318 to check the flag HT. If the flag HT is at "1", this means that the performance keys 2*a* and 2*b* are being assigned to the pitch designation and they will have no particular effect on the note number determined at step S316, so that the CPU 24 goes to step S322.

If, on the other hand, the flag HT is at "0", this means that the performance keys 2*a* and 2*b* are being assigned to the tone control and thus the CPU branches to step S319. Because the tone control is intended to change the parameter of the tone being generated, it is of course unnecessary to execute the tone control. Thus, it is determined at step S319 whether any tone is to be currently generated by detecting the breath pressure value as at step S311 above. If no player's blow is detected (i.e., BP=0), the CPU 24 judges that no tone is to be currently sounded; in this case, note-off data is issued to instruct muting of the tone at step S313, and then the CPU 24 reverts to step S301 to proceed with next performance state detection.

If a tone is to be currently generated as determined at step S319, there exists a need for tone control, so that the CPU 24 issues a MIDI-standard control-change data at step S320. The control-change data concerns a foot controller of control change No. 4 and contains, as parameters, A/D-converted values from the values KPa and KPb, so that the tone is controlled in accordance with the key depression force applied by the player. Thus, tone control is executed which depends on a particular type of control selectively set in the tone generator section 241 and level data (the above-mentioned A/D-converted values). Namely, the subject of the tone control is also variable by changing settings in the tone generator section 241.

After that, a note number to be newly sounded is calculated by treating the KP values of these keys 2*a* and 2*b* (KPa and KPb) as "0" and then stored into the "note number" register at step S321 similarly to step S308, and the CPU 24 moves to step S322. Then, a comparison is made at step S322 between the stored contents of the "note number" and "last note" registers. If the stored variables "note number" and "last note" do not match as determined at step S322, the CPU 24 goes to step 323, while if the "note number" and "last note" match, the CPU 24 proceeds to step S326.

Namely, step S323 is taken upon judgement that the fingering or finger placement (in other words, key operation pattern) has been changed to vary the tone pitch, and the content of the "note number" register is set into the "last note" register at this step. After step S323, the CPU 24 goes to step S324 in order to output note-off data so that the tone of the pitch having been sounded so far is muted or deadened. Subsequently, the stored content of the "last note" register is output as a note number along with note-on data at step S325, and the CPU 24 proceeds to step S326. At step S326, the CPU 24 detects one of the currently depressed or turned-ON performance keys which is at the lowest location of all and the KP value of the detected lowest-located key is set into the "PP" register (not shown).

A pressure value is determined, according to the stored value in the "PP" register, to output after-touch information at step S327 following step S326, and the CPU 24 loops back to step S311, after which the operations of steps S311 to S327 will be repeated unless the CPU 24 loops back to step S301 upon detection of a zero breath pressure value. Note that the operations of steps S326 and S327 may be replaced with that of step S17 of the first embodiment for execution of the slur control, when necessary.

As may be clear from the foregoing description, the ROM 25 and CPU 24 (and the tone generator section 241) together constitutes a tone control parameter generating means for generating a parameter for tone control, other than for pitch designation, in response to player's operation of the keys 2*a* and 2*b* while they are designated as "special keys" by the mode designating means. The tone control parameter corresponds to control data generated at step S320.

Briefly stated, the second embodiment of the present invention comprises: a depression-state detecting means (process executed by the CPU 24) for detecting the respective depression states of the individual pitch-designating keys; a pitch determining means (process executed by the CPU 24 and the fingering table in the ROM 25) for detecting the ON/OFF states of the keys on the basis of values representative of their detected depression states and determining a tone pitch on the basis of the detected ON/OFF states; and a tone control signal generating means (process executed by the CPU 24) for generating a tone control signal (e.g., after-touch information) on the basis of the detected depression state value of a predetermined (e.g., lowest- or highest-located) one of the keys.

Thus, as the depression force on the predetermined key is modified by the player, the tone control signal generating means generates a tone control signal corresponding to the modified depression force. With this arrangement, it is possible to easily impart an effect, such as a vibrato, to the tone in a very simple manner.

The following paragraphs describe various modifications of the third embodiment of the invention. According to the above-described third embodiment, when the mode-designating switch in the DIP switch unit is not activated, a tone pitch is designated depending on a combination of the respective operational states of all the pitch-designating keys 2*a* to 2*p* and a tone of the thus-designated pitch is generated by the tone information generating means. When the mode-designating switch in the DIP switch unit is activated to convert the keys 2*a* and 2*b* to the special keys, the tone information generating means is caused to generate a tone of a pitch determined on the basis the respective operational states of the pitch-designating keys excluding the special keys 2*a* and 2*b,* and the tone control parameter generating means is caused to generate a tone control parameter, distinct from a pitch designation parameter, in response to activation of the special keys. The tone control can be varied in an analog manner in the third embodiment. Namely, when the high trill keys are activated in the "HT=0" mode during generation of a tone at a given pitch, various effects, including a tone color change, and degree of the effects can be controlled in accordance with the KP values of the keys Pa and Pb (KPa and KPb). Further, the third embodiment has been described as determining a tone pitch on the basis of a combination of the ON/OFF states of the individual keys by detecting the outputs from the analog pressure-sensitive key sensors 2Sa to 2Sp greater or smaller than a predetermined level.

However, as one modification of the third embodiment, the key sensors 2Sa to 2Sp may be simple ON/OFF switches of the mechanical contact type rather than the pressure-sensitive type. This way, the operations of the key sensors can be greatly simplified although only the ON/OFF state of a tonal effect (such as sustain, reverberation or portamento) will be contained in the control-change information.

Where the high trill keys 2*a* and 2*b* are implemented by the simple ON/OFF switches, one of the keys 2*a* may be a switch that is electrically of a push-on-push-off type and mechanically of a self-returning type, while the other key 2*b* may be switch that is electrically of a push-on-release-off type and mechanically of a self-returning type. Further, whereas the effect control in the third embodiment has been described above as being a control change (foot controller of control change No. 4), the effect of pitch bend, tone volume, tone color, depth or rate of tremolo, vibrato pitch, roughness unique to saxophone, or the like may be controlled. Selection of any desired one of these effects may be made via the DIP switches.

Description on Fourth Embodiment

The fourth embodiment is characterized by being capable of designating the function of the octave keys U1, U2, D1 and D2 shown in FIG. 10. All the elements, other than the octave keys U1, U2, D1 and D2, are substantially of the same construction as in the third embodiment and hence will not be described here to avoid unnecessary duplication.

The octave keys U1, U2, D1 and D2 are similar in construction to the above-mentioned performance keys 2*a* to 2*p* and are capable of detecting A/D-converted values of player's depression force thereon. The A/D-converted depression force values of these octave keys U1, U2, D1 and D2 will be described as KPU1, KPU2, KPD1 and KPD2. The function of the octave keys U1, U2, D1 and D2 can be designated via the DIP switch unit 103. Turning ON the second switch DS2 places the octave keys in MODE 1 (M 1) and turning OFF the second switch DS2 places the octave keys in MODE 0 (M=0), as will be described later.

Now, operation of the fourth embodiment will be described with reference to the flow chart of FIGS. 15 and 16. First, at step S501, the function of the octave keys U1, U2, D1 and D2 are set via the DIP switch unit 103 (DIP switch setting operation); that is, when the second switch DS2 is set ON, the octave keys U1, U2, D1 and D2 operate in MODE 1 to carry out both octave conversion and control change, while when the second switch DS2 is set OFF, the octave keys U1, U2, D1 and D2 operate in MODE 0 to carry out only the octave conversion.

Figure 17:
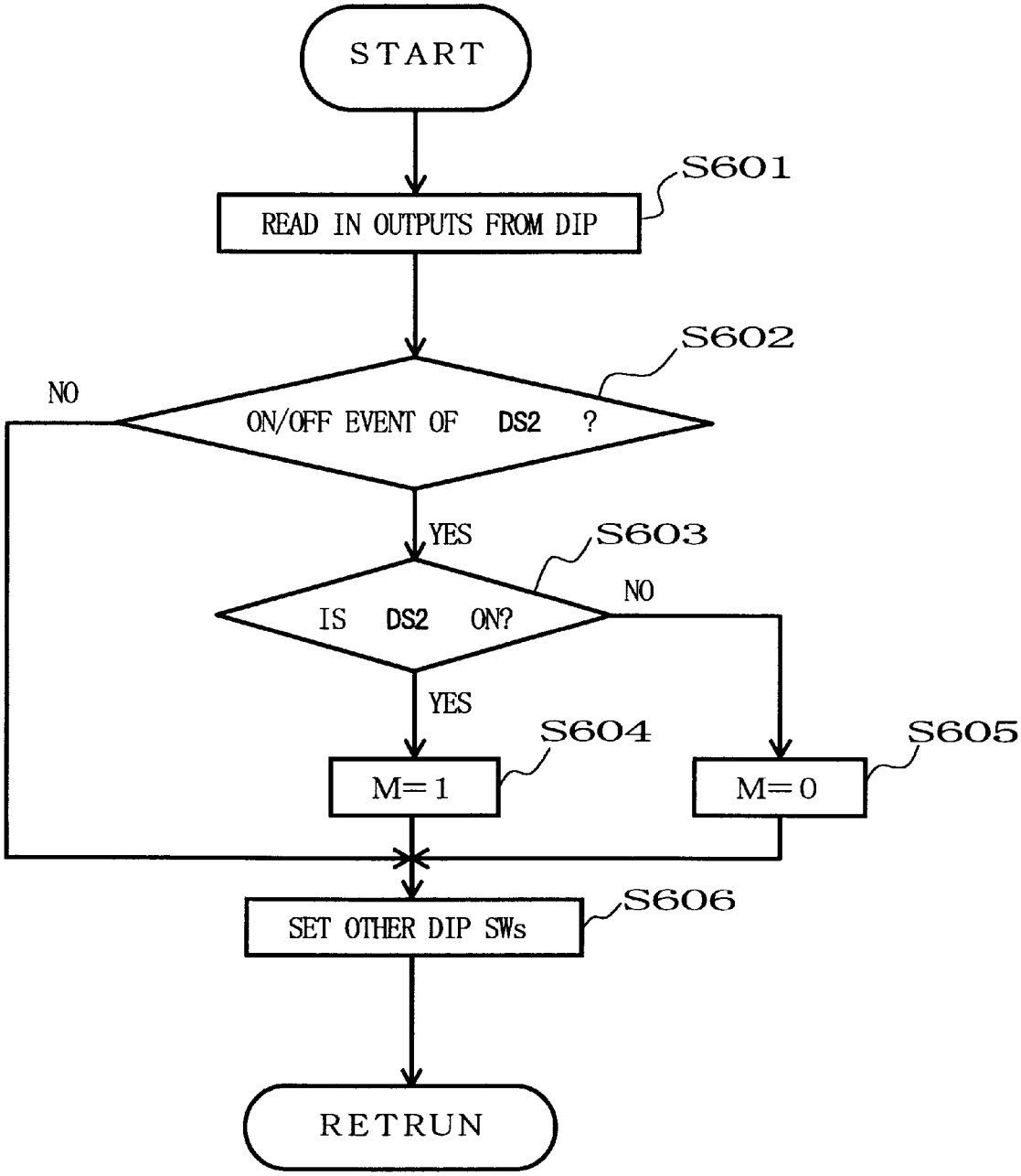
FIG. 17 is a flow chart of a DIP switch setting operation carried out in the fourth embodiment.

FIG. 17 is a detailed flow chart of the DIP switch setting operation. First, the CPU 24 reads in outputs from the DIP switch unit 103 at step S601 and then determines at step S602 whether there has been an ON/OFF event of the second switch DS2. With an affirmative answer (YES) at step S602, a further determination is made at next step S603 as to whether the second switch DS2 has been turned ON. If the second switch DS2 has been turned ON, the octave keys U1, U2, D1 and D2 are placed in MODE 1 (M=1) at step S604, while the second switch DS2 has been turned OFF, the octave keys U1, U2, D1 and D2 are placed in MODE 0 (M=0) at step S605. Here, M represents a flag showing whether the octave keys U1, U2, D1 and D2 are placed in MODE 1 (i.e., the switch DS2 is ON) or in MODE 0 (i.e., the switch DS2 is OFF).

After completion of the M flag operation at step S604 or S605, or if there has been no ON/OFF event of the second switch DS2 as determined at step S602, the CPU 24 proceeds to step S606 in order to carry out setting operations of the other switches DS1, DS3, . . . , DSn that are used for respective functions allocated thereto. The setting operations of the other switches are conducted similarly to those of steps S601 to S605, using different flags.

Figure 15:
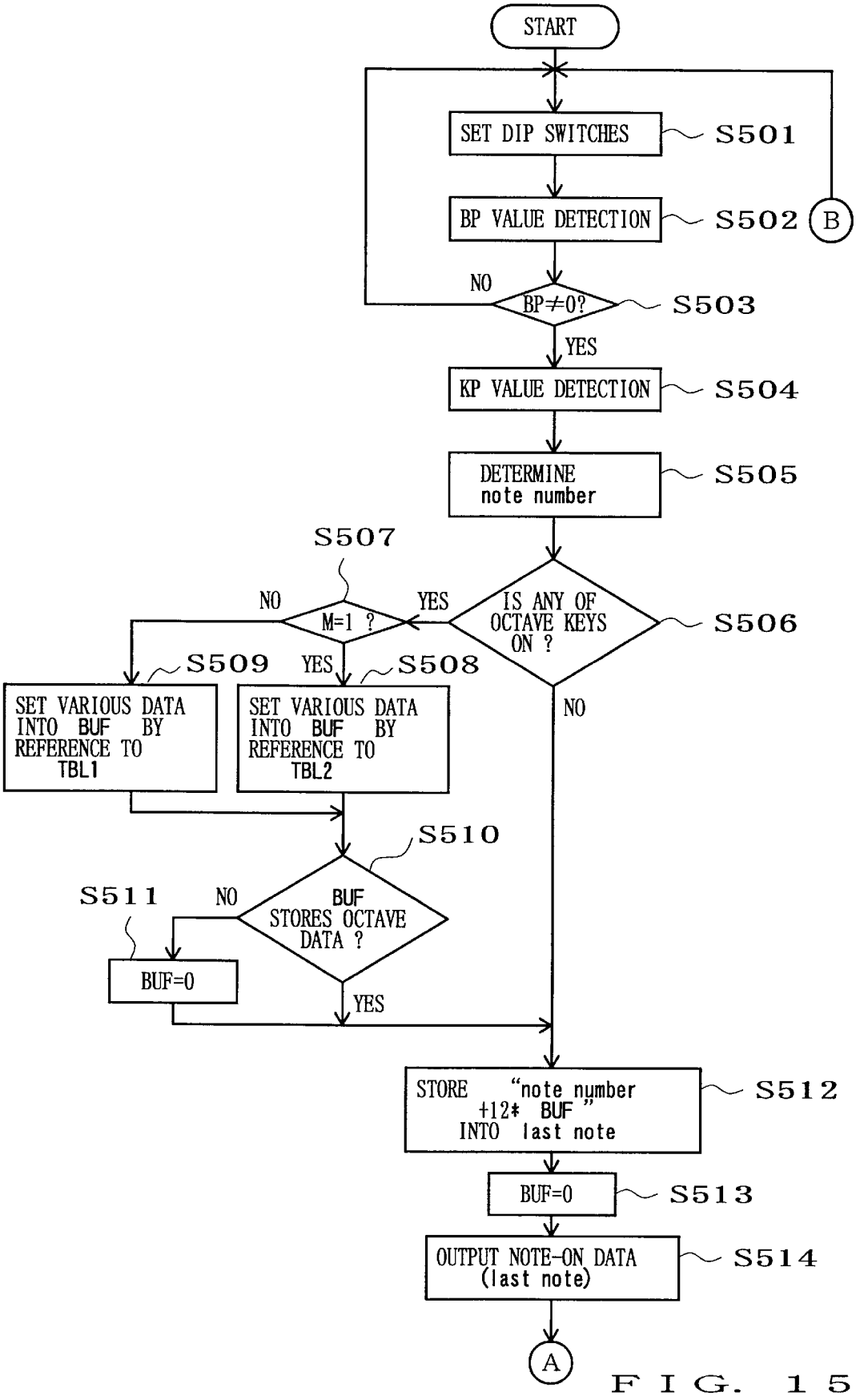
FIG. 15 is a flow chart illustrating part of exemplary operations carried out by the CPU in a fourth embodiment of the present invention.
Figure 16:
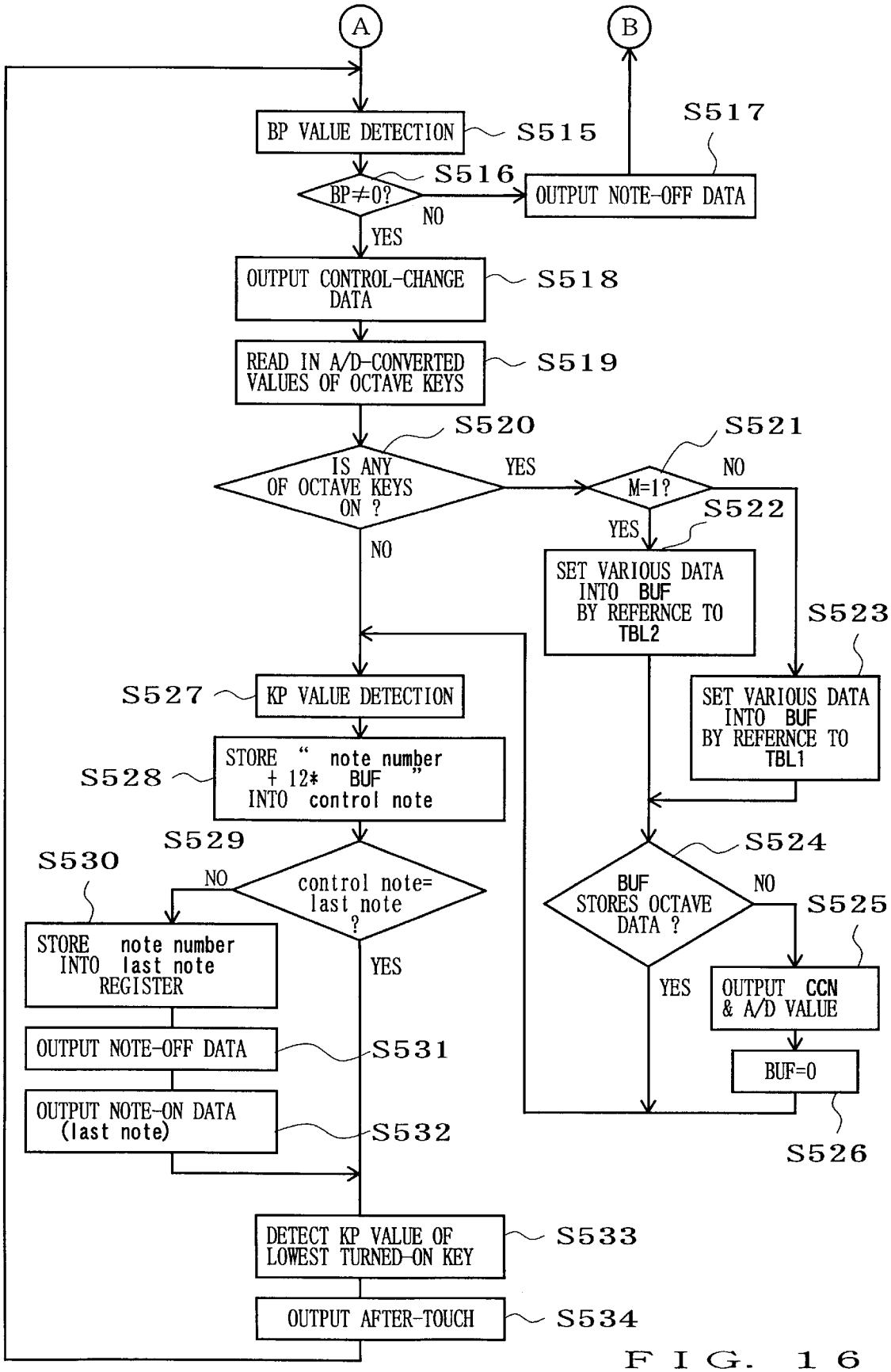
FIG. 16 is a flow chart illustrating the remaining part of the operations carried out by the CPU in the fourth embodiment of the present invention.

Referring back to the flow chart of FIG. 15, the CPU 24 detects the current breath pressure (BP) value at step S502 following the setting operation of step S501. It is then determined at next step S503 whether the detected breath pressure value is other than "0" (BP≠0) or not. If the detected breath pressure value is "0" (NO), the CPU 24 loops back to step S501. If, on the other hand, the detected breath pressure value is not "0", the CPU 24 sequentially detects respective KP values, i.e., A/D-converted depression force values, of all the keys KPa to KPp at step S504, and it then determines a performed note number on the basis of the respective ON/OFF states of the keys by reference to the fingering table in the ROM 25 (fingering chart of FIG. 5) and stores the thus-determined note number into the "note number" register at step S505.

Then, at step S506, it is ascertained whether or not any of the octave keys U1, U2, D1 and D2 has been operated or turned ON by the player. If none of the octave keys U1, U2, D1 and D2 has been turned ON as determined at step S506, this means that there is no need to carry out an octave conversion operation on the note number determined at step 505, and thus the CPU 24 goes to step S309. If any of the octave keys U1, U2, D1 and D2 has been turned ON, this means that there has been issued an instruction to execute the octave conversion operation and that the note number determined at step 505 is not the same as one to be actually sounded. Consequently, with the affirmative determination at step S506, the CPU 24 moves to step S507 for determination of the current mode.

The CPU 24 will carry out different operations depending on the current mode determined at step S507. If the current mode is not MODE 1 (i.e., M=0), the CPU 24 goes to step S509 to refer to a table TBL1 for MODE 0 stored in the ROM 25. FIGS. 18A and 18B show tables for use in operations in the individual modes. Specifically, the table TBL1 of FIG. 18A shows numerical values each of which is to be output in accordance with a current detected combination of ON(1)/OFF(0) states of the octave keys U1, U2, D1 and D2. For example, for the combination on the first or uppermost row of the table TBL1, only the octave key D1 is ON and the output numerical value is "−2". The output numerical value represents an amount of octave conversion to be effected; for example, the value "−1" represents a downward conversion or shift by one octave, "−2" a downward conversion by two octaves, "+1" an upward conversion by one octave, and "+2" an upward conversion by two octaves. The output numerical value "0" indicates that no octave conversion be effected.

In determining the ON/OFF states of the octave keys U1, U2, D1 and D2, each of these keys is determined to be in the OFF state if its KP value is "0" and determined to be in the ON state if its KP value is in the range from "1" to "10", although the invention is not so limited.

Referring back to the flow chart of FIG. 15, the value thus obtained by reference to the table TBL1 is stored into a register for variable BUF at step S509, and then the CPU 24 proceeds to step S510. If the current mode is MODE 1 (M=1) as determined at step S507, then the CPU 24 goes to step S508 to refer to a table TBL2 for MODE 1 stored in the ROM 25. The table TBL2 of FIG. 18B shows numerical values each of which is to be output in accordance with a combination of ON(1)/OFF(0) states of the octave keys U1, U2, D1 and D2 or represents a tone control instruction. For example, for the combination on the first or uppermost row of the table TBL2, only the octave key D1 is ON, in which case a code (CNN) instructing issuance of control-change data corresponding to the KP value of the octave key D1 will be output. The control-change data concerns, for example, the foot controller (control change No. 4) or tone volume control (control change No. 7). For the combination on the third row of the table TBL2, only the octave key D2 is ON, in which case a value "−1" will be output.

Namely, in MODE 1, when the octave key D1 or U2 is ON, the octave keys are used for the tone control (control change), and when only the octave key D2 or U1 is ON, a one-octave conversion is carried out. The value thus obtained by reference to the table TBL2 is stored into the "BUF" register at step S508, and then the CPU 24 proceeds to step S510.

At step S510, a determination is made as to whether the current stored content of the "BUF" register is octave data that is any of the values "−2", "−1", "0", "+1" and "+2" obtained by reference to the table TBL1 or TBL2. After step S510, the CPU 24 goes to step S512 in order to generate a tone octave-converted, from the note number determined at step S505, by an amount corresponding to the value stored in the "BUF" register.

In the event that the value obtained by reference to the table TBL1 or TBL2 is the code (CNN) instructing issuance of control-change data, the CPU 24 determines the current stored content of the "BUF" register as being not octave data and then goes to step S511 to set a value "0" into the "BUF" register. Because no tone has been generated yet at this stage, there is no tone to be subjected to a control change. Thus, let's assume here that the code stored in the "BUF" register is disregarded and a tone of the note number determined at step S505 is initially generated. After that, a value "0" is set into the "BUF" register at step S511, so as to determine, at step S512, a note number by use of the value stored in the "BUF" register.

More specifically, the note number determination at step S512 is carried out in the following manner. The note number determined at step S505 has been stored in the "note number" register, and the amount of octave conversion to be effected has been stored in the "BUF" register (see steps S508 and S509). So, the note number to be actually sounded is calculated by the following equation and stored into the "last note" register:

$$\text{"last note"}=\text{"note number"}+12 * \text{"BUF"} \qquad \text{Equation (1)}$$

If "note number"=60 (pitch name "do": C3) and "BUF"=+1, then "last note" will be 60+12×1=72 (pitch name "do": C4), so that a note number converted upward by one octave will be actually sounded. If "note number"=60 (pitch name "do": C3) and "BUF"=−2, then "last note" will be 60+12×(−2)=36 (pitch name "do": C1), so that a note number converted downward by two octaves will be actually sounded. Further, if "note number"=60 (pitch name "do": C3) and "BUF"=0, then "last note" will be 60+12×0=60 (pitch name "do": C3), so that no octave conversion will take place.

At step S513 following the note number determination of step S512, a value "0" is set into the "BUF" register in readiness for determination of a next note number, because if the current stored value in the "BUF" register remains unchanged, an octave conversion will be executed even without any of the octave keys being operated by the player (see steps S519 to S528 that will be described below). After step S513, note-on data is output at step S514 which contains the stored content of the "last number" register as a note number.

Subsequently, the CPU 24 moves on to step S515 of FIG. 16 for second execution of the performance states detection. Namely, the CPU 24 again detects the current breath pressure (BP) value at step S515 and then determines at next step S516 whether the detected breath pressure value is other than "0" (BP≠0) or not. If the detected breath pressure value is "0" as determined at step S516, the CPU 24 goes to step S517 in order to instruct muting of the tone and then reverts to initial step S501. If, on the other hand, the detected breath pressure value is other than "0", the CPU 24 outputs control-change data corresponding to the detected breath pressure value at step S518 and again reads in respective current KP values of the individual octave keys KPU1, KPU2, KPD1 and KPD2 at next step S519.

At step S520 following step S519, a determination is made as to whether or not any of the octave keys U1, U2, D1 and D2 has been operated or turned ON by the player, similarly to step S506 mentioned above. If none of the octave keys U1, U2, D1 and D2 has been operated as determined at step S520, there is no need to execute an octave conversion and hence no need to change the note number; that is, the value "0" stored in the "BUF" register earlier at step S513 may be left unchanged. If, on the other hand, any of the octave keys U1, U2, D1 and D2 has been operated by the player, it means that an instruction to effect an octave conversion has been issued and a note number to be determined at step 527 is not the same as one to be actually sounded. Following operations of steps S521 to S523 are similar to those of steps S507 to S509 and therefore will not be described here to avoid unnecessary duplication.

If the value stored in the "BUF" register at step S522 or S523 is octave data as determined at step S524, the CPU 24 moves on to step S527. If, however, the value stored in the "BUF" register is a code instructing issuance of control-change data, the CPU 24 goes step S525 in order to output control-change data corresponding to the KP value of the turned-ON octave key (e.g., KPU1); this operation can change the tone generated at step S514. Then, a value "0" is set at step S526 into the "BUF" register so that the octave conversion does not take place, after which the CPU 24 proceeds to step S527. At step S527, respective current KP values of the individual performance keys are detected, so that a note number is determined on the basis of the detected KP values by reference to the fingering chart and stored into the "note number" register.

After that, the note number calculated using Equation (1) above is stored into a register for variable "control note" at step S528. The stored content in the "control note" register is used to compare the currently sounded note number and the note number determined on the basis of the current detection. If the "control note" and "last note" do not match as determined at step S529, it is necessary to mute the currently generated tone and sound a new note number because a pitch change has been instructed, so that the CPU 24 goes to step S530 in order to set the stored value of the "control note" register into the "last note" register. After step S530, note-off data is output at step S531. Note-on data with the "last note" as a note number is then output at next step S532, and thereafter the CPU moves on to step S533.

If the "control note" and "last note" match as determined at step S529, it is not necessary to mute the currently generated tone and sound a new note number because no pitch change has been instructed, so that the CPU 24 goes directly to step S533. At step S533, the CPU 24 detects one of the currently turned-ON performance keys which is at the lowest location among all the keys and stores the KP value of the lowest-located key into the "PP" register (not shown).

At step S534, a pressure value is determined, on the basis of the stored value in the "PP" register, to output after-touch information, after which the CPU 24 loops back to step S515. In this way, the operations of steps S515 to S534 will be repeated until the breath pressure value becomes zero.

Note that the operations of steps S533 and S534 may be replaced with that of step S17 of the first embodiment for execution of the slur control, when necessary.

The above-described fourth embodiment may be modified as follows. The control change number output by control-change data may be preset, or selected as via the DIP switch unit 103. The octave keys U1, U2, D1 and D2, which have been described as pressure-sensitive switches, may be simple ON/OFF switches such as the mechanical contact switches or optical switches, in which case, however, the control change parameter designated in the table TBL2 is represented in a binary number.

As having been so far described, the fourth embodiment is characterized in that it replaces the tone control parameter, generated by the tone generating means in the third embodiment, with a parameter instructing a tone pitch change by the octave. As a result, the fourth embodiment permits a rapid pitch change by the octave.

Description on Fifth Embodiment

Figure 19A:
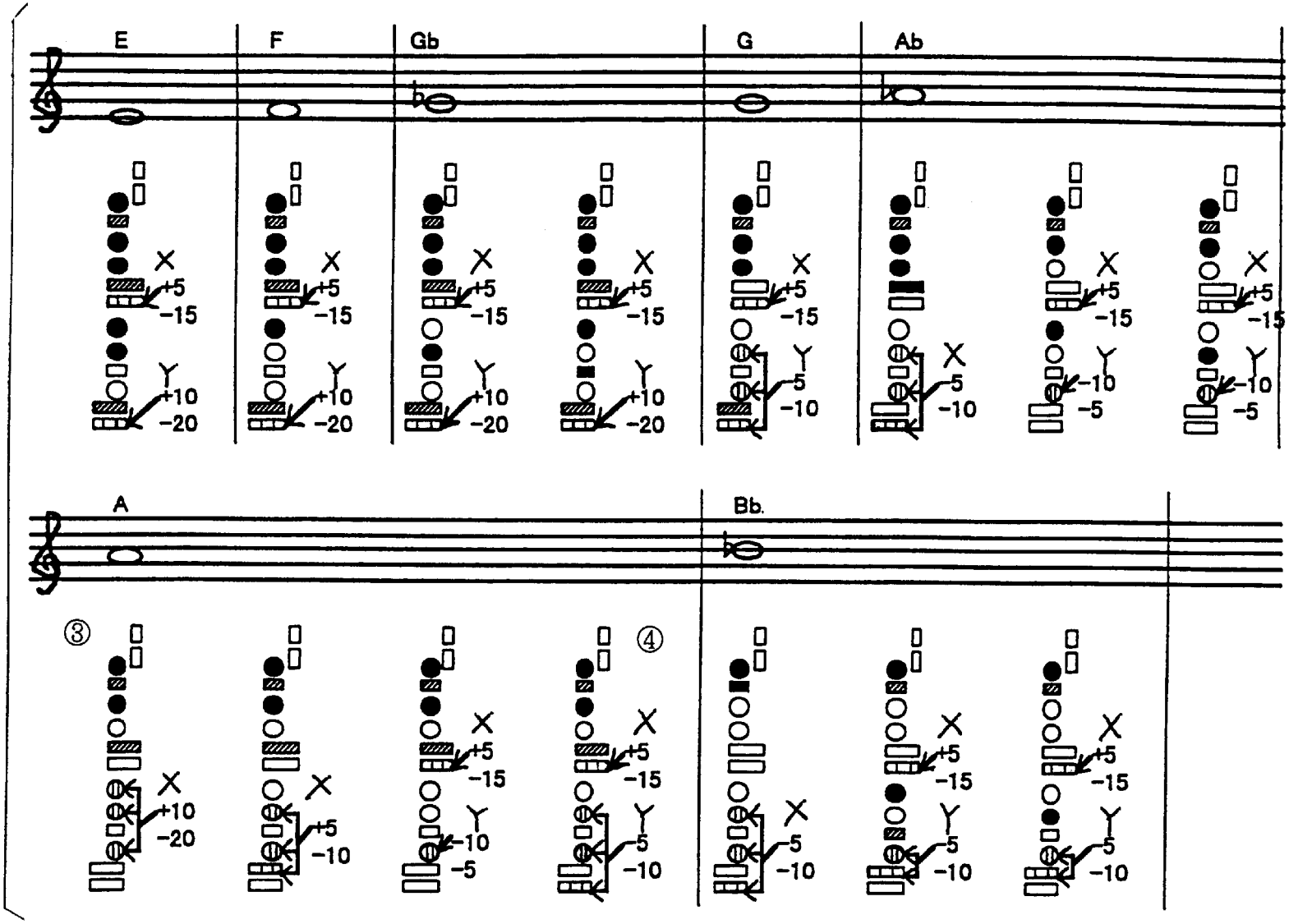
FIGS. 19A and 19B are diagrams showing an example of a fingering chart for special alternate fingering according to a fifth embodiment of the present invention.
Figure 19B:
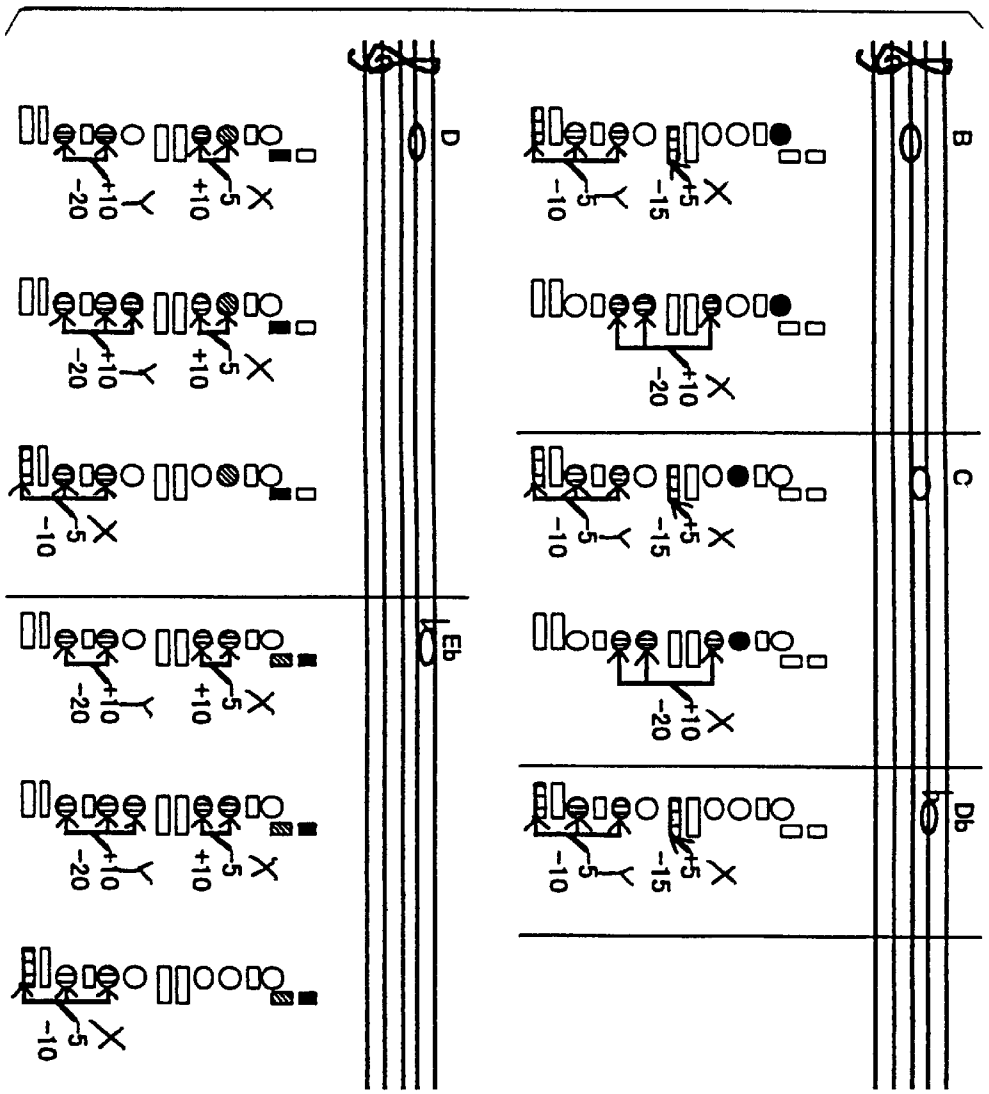

The basic fingering chart of FIG. 5 shows modes of finger placement or key operation based on the standard alternate fingering as well as the basic fingering for the individual notes. FIGS. 19A and 19B show an example of a fingering chart for the special alternate fingering and more particularly show modes of finger placement or key operation based on the special alternate fingering according to the fifth embodiment of the present invention; for convenience of illustration, the fingering chart is shown as divided into two parts. The placement or distribution of the keys in FIGS. 19A and 19B corresponds to that of keys 2*a* to 2*p* shown in FIG. 1.

In FIGS. 19A and 19B, keys, each denoted in a horizontal rectangular block with short vertical lines along with arrow X or Y, are intended to be invariably depressed, in addition to the basic fingering, in order to effect the special alternate fingering according to the present embodiment. Further, other keys, each denoted in horizontal rectangular block with hatching, are intended to be optionally depressed and do not affect modification of the tone pitch and color at all whether they are depressed or not. Here, one or more keys denoted by arrows X and Y are capable of being operated selectively or simultaneously to effect the special alternate fingering. Namely, a predetermined performance style or key operation pattern according to the special alternate fingering can be effected by only operating the one or more keys denoted by arrow X in addition to the basic fingering; another predetermined special alternate fingering style, slightly different from the above-mentioned, can be effected by only operating the one or more keys denoted by arrow Y in addition to the basic fingering; and yet another predetermined special alternate fingering style, still slightly different from the above-mentioned, can be effected by only operating a plurality of the keys denoted by arrows X and Y in addition to the basic fingering.

In a situation where a plurality of styles, i.e., different key operations, of the special alternate fingering (hereinafter "special-alternate-fingering key operations") are available for a given note (this is true in many cases such as the example shown in FIGS. 19A and 19B), the tone pitch and color are controlled to subtly differ between the different key operations. For this purpose, predetermined tone-pitch modification and tone-color modification amounts are preset for each of the special-alternate-fingering key operations shown in FIGS. 19A and 19B. Of the two numbers written in vertical succession in relation to each of arrows X and Y, the upper number represents a tone-pitch modification amount for the alternate-fingering key operation relative to a predetermined pitch (regular pitch) of a given pitch name corresponding to the basic fingering key operation, while the lower number represents a tone-color modification amount.

Examples of these modification amounts are explained as follows in relation to a particular key-operation pattern denoted at ③ in FIG. 19A as a special-alternate-fingering key operation pattern for pitch name "A". A tone-pitch modification amount of a data value +5 (cents) and tone-color modification amount of a data value −15 are allocated to a key operation corresponding to an additional key operation of the alternate fingering denoted by arrow X. A tone-pitch modification amount of a data value −5 (cents) and tone-color modification amount of a data value −10 are allocated to the additional alternate-fingering key operation denoted by arrow Y. It is assumed here, for convenience of description, that when the additional alternate-fingering key operation denoted by arrows X and Y are executed simultaneously, the present embodiment uses, as the tone-pitch modification and tone-color modification amounts, respective sums of the modification amounts for the two operations; that is, in the case of a pattern denoted at ④ in FIG. 19A, the tone-pitch modification will be +5−5=0 and the tone-color modification amount will be −15−10=−25. Let's also assume that in case the resultant sum of the tone-pitch modification amounts is zero, the present embodiment operates to modify a predetermined note number by a semitone, as will be described later.

In the present embodiment, a predetermined fingering table TBL, corresponding to the basic fingering chart of FIG. 5 and the special alternate fingering chart of FIGS. 19A and 19B, is prestored in the ROM 25 or RAM (not shown). The basic fingering chart stored in the fingering table TBL may be in the conventionally-known data storage format, and a portion of the fingering table TBL, corresponding to the basic fingering chart, contains at least relationships between various combinations of ON/OFF states of the individual keys and information (note numbers) indicative of respective notes (pitch names or scale notes) determined by the combinations. By contrast, another portion of the fingering table TBL, corresponding to the special alternate fingering chart of FIGS. 19A and 19B, contains information indicative of the tone-pitch modification and tone-color modification amounts for each of the alternate-fingering key operations in addition to the information (note numbers) indicative of respective notes determined by the combinations.

Also, in the present embodiment, it is assumed that each of the note numbers stored in the fingering table TBL in corresponding relation to a key operation of the special alternate fingering indicates a particular note that differs, by a semitone, from a note corresponding to the basic fingering (namely, a desired note to be performed), rather than directly indicating that desired note. For example, in a situation where the tone-pitch modification amount determined in accordance with a specific special-alternate-fingering key operation (see FIGS. 19A and 19B) is intended for an upward pitch shift over "x" cents relative to the regular pitch of the desired note, a value obtained by adding "1" to the note number of the desired note is stored as a note number so as to actually designate a note higher than the desired note by a semitone (100 cents). In this case, upon receipt of the note number, the tone generator section 241 can generate a tone having a pitch shifted upward "x" cents relative to the regular pitch of the desired note, by controlling the tone of the designated note, higher in pitch than the desired note by a semitone, to assume a pitch lower by "100−x" cents.

Further, in another exemplary situation where the tone-pitch modification amount determined in accordance with a specific special-alternate-fingering key operation is intended for a downward pitch shift over "x" cents relative to the regular pitch of the desired note, a value obtained by subtracting "1" from the note number of the desired note is stored as a note number so as to actually designate a note lower than the desired note by a semitone (100 cents). In this case, upon receipt of the note number, the tone generator section 241 can generate a tone having a pitch shifted downward "x" cents relative to the regular pitch of the desired note, by controlling the tone of the designated note, lower in pitch than the desired note by a semitone, to assume a pitch higher by "100−x" cents. In general, if the pitch control is to be performed in a variable, subtle manner without completely losing the feeling of the desired note's regular pitch, then it may be more appropriate to set the above-mentioned tone-pitch modification amount to a value below 50 cents.

The reason why a note number differing from a note of the basic fingering by a semitone is designated in response to execution of each special-alternate-fingering key operation is to facilitate generation of new note-on information (note-on event data and note number) and also to allow the tone generator section 241 to apparently execute tone generation corresponding to a note differing, by a semitone, from the note of the basic fingering, to thereby add significant modulation to a performed tone.

Note that each of the note numbers stored in the fingering table TBL in corresponding relation to the individual special-alternate-fingering key operations may comprise a note number corresponding to the basic fingering and additional data instructing addition or subtraction of the value "1" to or from the note number of the basic fingering, in stead of the note number already modified by ±1 as mentioned above; in this case, a note number greater or smaller by one than the basic-fingering note number will be obtained by reading out the stored note number for subsequent addition or substraction to or from the basic-fingering note number.

Further, according to the present embodiment, each of the tone-pitch modification amounts stored in the fingering table TBL in corresponding relation to the individual special-alternate-fingering key operations is stored as data indicative of a difference between the pitch corresponding to the note number (greater or smaller by one than the basic-fingering note number) stored in the table TBL in corresponding relation to the special-alternate-fingering key operation and the pitch obtained by applying the tone-pitch modification amount to the regular pitch of the note corresponding to the special-alternate-fingering key operation, rather than as data directly indicative of a predetermined tone-pitch modification amount preset for that alternate-fingering key operation.

For example, if a tone-pitch modification amount for a given note corresponding to a particular one of the special-alternate-fingering key operations (see FIGS. 19A and 19B) is intended for an upward pitch shift over "x" cents relative to the regular pitch, a value of "−(100−x)" cents is prestored in the fingering table TBL as tone-pitch modification amount information. In this case, upon receipt of the note number read out from the fingering table TBL (designating a note higher by a semitone than the given note) and pitch-bend information, the tone generator section 241 can generate a tone having a pitch shifted upward "x" cents relative to the regular pitch of the given note, by controlling the tone of the designated note, higher in pitch than the given note by a semitone (100 cents), to assume a pitch lower by "100−x" cents.

In another situation where a tone-pitch modification amount for a given note corresponding to a particular one of the special-alternate-fingering key operations (see FIG. 6) is intended for a downward pitch shift of "x" cents relative to the regular pitch, a value of "+(100−x)" cents is prestored in the fingering table TBL as tone-pitch modification amount information. In this case, upon receipt of the note number read out from the fingering table TBL (designating a note lower by a semitone than the given note) and pitch-bend information, the tone generator section 241 can generate a tone having a pitch shifted downward "x" cents relative to the regular pitch of the given note, by controlling the tone of the designated note, lower in pitch than the given note by a semitone (100 cents), to assume a pitch lower by "100−x" cents.

When the alternate-fingering key operations denoted by arrows X and Y, as shown at ④ in FIG. 19A, are executed simultaneously and if the sum of the tone-pitch modification amounts for the two key operations is zero, a note number indicative of a note higher by a semitone than the regular pitch is stored in the fingering table TBL, and also information indicative of −100 cents is stored in the table TBL as corresponding pitch-bend data.

The fifth embodiment may be modified in such a manner that information directly indicative of predetermined tone-pitch modification amounts as shown in FIGS. 19A and 19B is stored in the fingering table TBL as the tone-pitch modification amount information in corresponding relation to the special-alternate-fingering key operations. In such a case, pitch-bend data indicative of a given difference value may be calculated by performing the above-mention arithmetic operation "−(100−x)" or "+(100−x)" on the tone-pitch modification amount "x" read out from the fingering table TBL.

Figure 20A:
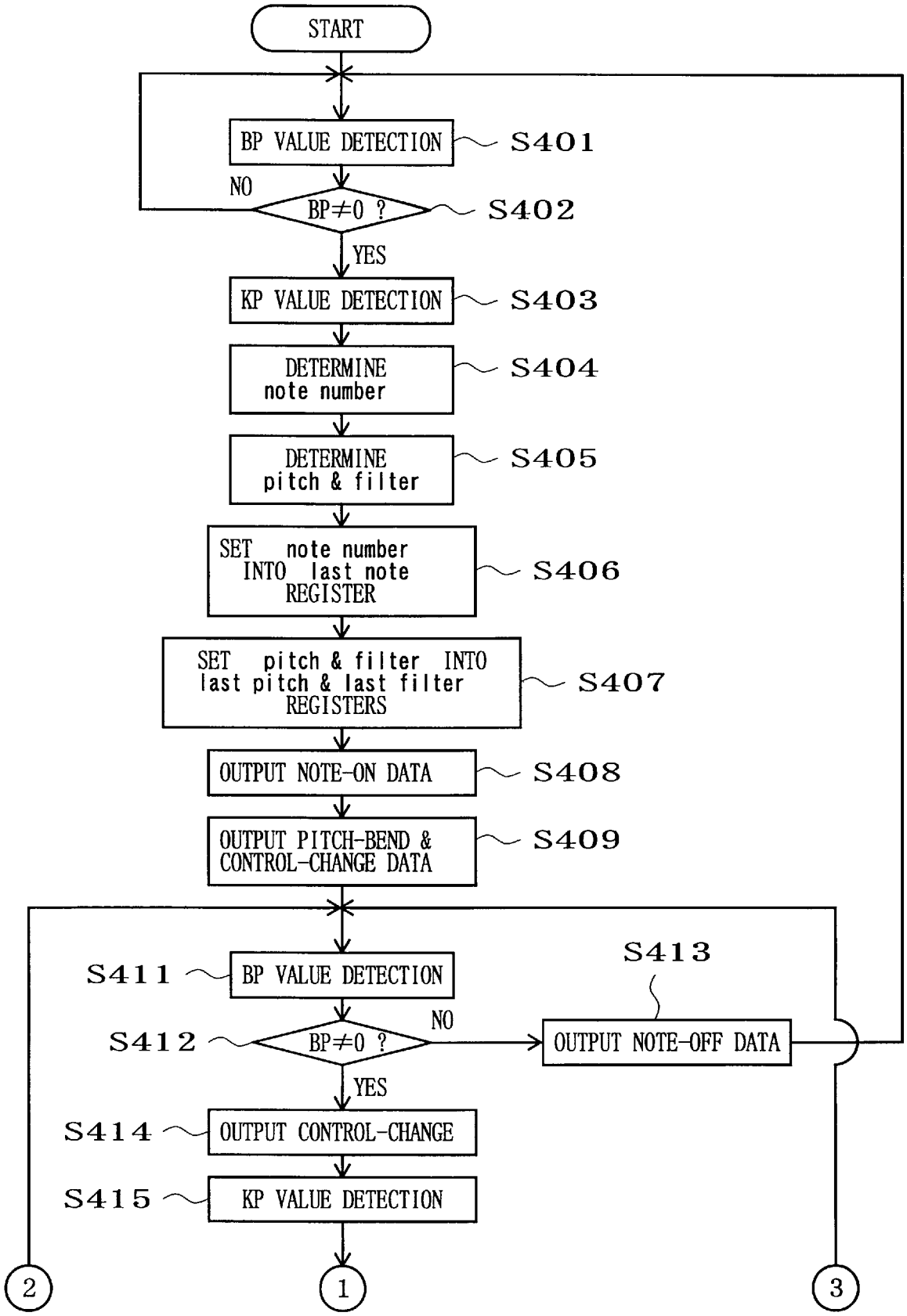
FIGS. 20A and 20B are flow charts showing exemplary operations carried out by the CPU in a fifth embodiment of the present invention.

Now, a detailed description will be made about exemplary behavior of the CPU 24 in the fifth embodiment with reference to FIGS. 20A and 20B. FIG. 20A is connected at its bottom end to the top of FIG. 20B so as to together represent a series of operations.

Figure 20B:
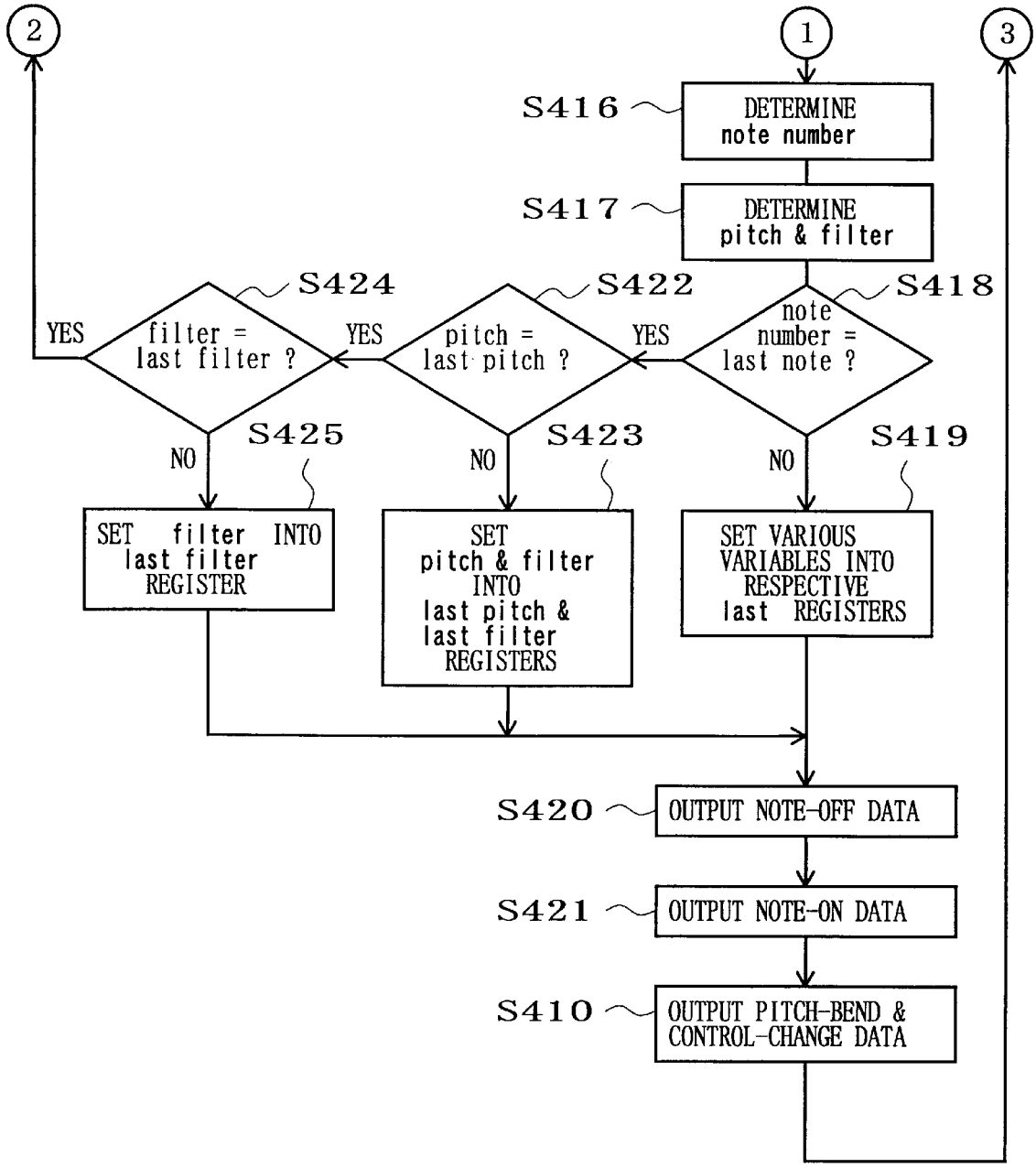

In FIGS. 20A and 20B, operations of steps S401 to S404, S406, S408 and S411 to S416 are generally similar to those of steps S1 to S4, S6 and S7 to S12 of FIG. 6. Particularly, step S404 of FIG. 20A is similar to step S4 of FIG. 6 in that an actually-performed note is determined on the basis of the respective ON/OFF states of the individual keys by reference to the fingering table TBL, but is different therefrom in that if the executed key operation corresponds to any one of the special alternate fingering schemes, a note number indicative of, rather than a note number indicative of a regular note corresponding to the basic fingering, a note higher or lower by a semitone than the regular note will be read out from the fingering table TBL.

At step S405 following step S404, pitch-bend data (corresponding to the above-mentioned tone-pitch modification amount) obtained by reference to the fingering table TBL is stored into a register as a variable "pitch", and tone-color modification amount information is stored into a register as a variable "filter". Note that the tone-color modification amount information comprises, for example, filter coefficient modification information to modify a filter coefficient of a tone color filter employed in the tone generator section 241. The operation of step S405 is carried out when the performed key operation corresponds to the fingering chart for the special alternate fingering of FIGS. 19A and 19B; that is, the special alternate fingering is intended to modify the tone color as necessary. When the performed key operation corresponds to the basic fingering chart of FIG. 5, the operation of step S405 may be omitted now that both of the tone-pitch and tone-color modification amounts are zero. Alternatively, the value "0" may be set as the variables "pitch" and "filter".

Then, the value of the variable "note number" is set into the "last note" register S406, after which the current stored values of the "pitch" and "filter" registers are set into registers for variables "last pitch" and "last filter", respectively, at step S407. After that, a MIDI message containing note-on data is output at step S408, followed by step S409 where the current stored values of the "pitch" and "filter" registers are output as pitch-bend data and control-change data in the MIDI format, respectively. The operation of step S409 is also carried out when the performed key operation corresponds to the fingering chart for the special alternate fingering of FIGS. 19A and 19B; however, when the performed key operation corresponds to the fingering chart of FIG. 5, it is omitted because there is no need to output pitch-bend data and control-change data.

Thus, when the breath pressure value has changed from the value "0" to another value in response to a player's blow into the mouthpiece 1, i.e., where a player's operation to instruct generation of a new tone has been executed, note-on data corresponding to a particular note determined on the basis of the current respective ON/OFF states of the individual keys is output in the MIDI format (step S408); if the current respective ON/OFF states of the individual keys represent the special alternate fingering, pitch-bend data and control-change data corresponding to predetermined tone-pitch and tone-color modification amounts representing that special alternate fingering are output in the format (step S409). These output MIDI data are fed to the tone generator section 241, which in turn starts generating the new tone corresponding to the note-on data. As conventionally known in the art, generation of the tone is started with "attack" characteristics (i.e., tonal characteristics of the attack portion). In the event that the pitch-bend data and control-change data are fed simultaneously, the pitch and color of the tone will also be controlled by the tone generator section 241 in accordance with these data.

It is also important to note that a typical example of the special alternate fingering comprises applying or adding and terminating a key operation corresponding to the special alternate fingering while continuing a key operation corresponding to the basic fingering. Thus, the operations of steps S405, S407 and S409 are not carried out in the typical example of the special alternate fingering, because it is normally impossible that such a key operation corresponding to the special alternate fingering is applied from the very beginning of a player's blow into the mouthpiece 1. However, the present embodiment may be arranged to carry out the operations of steps S405, S407 and S409, so as to permit predetermined tone pitch and tone color control for the special alternate fingering even when a key operation corresponding to the special alternate fingering is applied from the beginning of a player's blow into the mouthpiece 1. Thus, the fifth embodiment may be modified in such a manner that when a key operation corresponding to the special alternate fingering is applied from the beginning of a player's blow into the mouthpiece 1, only generation and control of a tone corresponding to the basic fingering are effected while disregarding the key operation; in such a case, steps S405, S407 and S409 may be eliminated.

Referring back to FIG. 20A, the current breath pressure value is detected at step S411, and it is then ascertained at step S412 whether or not the detected breath pressure value is other than "0". After executing the operations of steps S411 to S416 similar to those of steps S7 to S12 of FIG. 6, the CPU 24 moves on to step S417 of FIG. 20B. At steps S416 and S417, operations similar to those of steps S404 and S405 are carried out by reference to the fingering table TBL, in order to set variables "note number", "pitch" and "filter" in accordance with a combination of the current ON/OFF states of the individual keys. However, even when the key operation corresponds to the basic fingering chart of FIG. 5, a value "0" is set as the variables "pitch" and "filter" without the operation of step S417 being omitted at all, because there is a need to change pitch-bend and filter modification amounts to zero when the special-alternate-fingering key operation is terminated.

At following step S418, a determination is made as to whether the variables "note number" and "last note" match each other, to thereby detect any change in the ON/OFF states of the keys. If the variables "note number" and "last note" do not match each other (i.e., if a NO determination is made at step S418), it means that there has been an evident change in the fingering or key operation pattern, so that the CPU 24 proceeds to next step S419. In the present embodiment, different note numbers are allocated to a same note between one performance style (fingering) where a desired note is designated only by the basic fingering and another performance style where the desired note is designated by the special alternate fingering. Thus, as a change occurs from one condition where a desired note is performed only on the basis of the basic fingering to another condition where the desired note is performed with a predetermined key operation corresponding to the special alternate fingering, there would occur a difference between the note number of the last tone (the desired note corresponding to the basic fingering) and the note numbers of the new tone (the same desired note corresponding to the special alternate fingering), so that a negative determination is made at step S418. Similarly, as the predetermined key operation corresponding to the special alternate fingering is terminated, such a difference between the note numbers would also result, so that a negative determination is made at step S418.

If, on the other hand, the variables "note number" and "last note" match each other (i.e., if a YES determination is made at step S418), the CPU 24 goes to step S422 in order to further determine whether there has been a change in the fingering, because it is sometimes impossible to detect a fingering change from the note number alone. For example, in such a situation where a note number corresponding to given special alternate fingering for note "A" is equivalent to the regular note number of note "A" plus one and the regular note number of note "A#" is equivalent to the regular note number of note "A" plus one, the two note numbers coincide with each other, so that there will be no change in the note number value even when given special alternate fingering for note "A" is changed to the basic fingering for note "A#". If a plurality of styles, i.e., key operation patterns, corresponding to the special alternate fingering exist like those for note "A" as shown in FIG. 19A, then the two note numbers coincide with each other irrespective of the different key operations of the special alternate fingering, so that there will be no change in the note number value even when a given key operation corresponding to the special alternate fingering for note "A" is changed to another key operation corresponding to the special alternate fingering. Thus, to detect a fingering change in such situations, the present embodiment carries out operations of steps S422 and S424.

When there has been an evident change in the fingering, the flow goes from a negative determination at step S418 to step S419. At step S419, the variables "pitch" and "filter" are set into the "last pitch" and "last filter" registers, respectively. Then, at step S420, note-off data is output in the MIDI format so as to perform control for deadening the tone having so far been generated (hereinafter referred to as the "last tone"). After that, the CPU 24 goes to steps S421 and S410 to execute MIDI output operations, similar to those of steps S408 and S409, to thereby generate a new tone determined by the changed fingering. Namely, a new note number determined by the changed fingering (i.e., value of the variable "last note") and note-on data containing note-on event data are output in the MIDI format at step S421, and pitch-bend data determined by the changed fingering (i.e., value of the variable "last pitch") and control-change data (value of the variable "last filter") are output in the MIDI format at step S410.

Because no zero BP value is detected at and after S414, various tone control should normally be carried out during the tone generation. However, now that the note-on data is output (i.e., new note-on information is issued) at step S421 to the tone generator section 241, the section 241 will execute new key-on operations to start generating a new tone with its attack portion. For example, the tone generator section 241 judges the note-on data, supplied at step S421, to be the advent of a new key-on event and control the overall tone generating operations in such a manner to start generating the new tone with "attack" characteristics. For example, various tonal factors, such as a tone waveform, tone volume envelope, filter control envelope and pitch control envelope, will be controlled, starting with their respective "attack" characteristics.

In this way, whenever a performance based on the special alternate fingering is carried out by, for example, repeating application or termination of a particular key operation corresponding to the special alternate fingering while another key operation corresponding to the basic fingering is being executed for a desired note, the CPU 24 goes from the negative determination at step S418 to step S421 to thereby generate note-on data, so that generation of a tone corresponding to the special-alternate-fingering key operation can be initiated while being controlled with its "attack" characteristics. This way, It is possible to add significant modulation to a performed tone in response to a key operation corresponding to the special alternate fingering. Of course, the tone pitch and color can be subtly varied in response to the special-alternate-fingering key operation now that pitch-bend data and control-change data are output in the MIDI format at step S410. Further, when the special-alternate-fingering key operation is terminated, the regular or original tone pitch and color can be restored because a value "0" is output as the pitch-bend data and control-change data. After step S410, the CPU 24 loops back to step S411.

After the determination at step S418 that there has been no change in the note number, the CPU 24 goes to step S422 to detect a change in the fingering by comparing the variable "pitch" (pitch-bend data currently read in from the fingering table TBL) and the variable "last pitch" (pitch-bend data output most recently in the MIDI format). Namely, even when no change has been detected in the note number, the CPU 24 determines that there has been a change in the fingering as long as the variables "pitch" and "last pitch" does not match each other. Thus, with a negative determination at step S422 (pitch≠last pitch), the CPU 24 proceeds to step S423 in order to set the variables "pitch" and "filter" into the "last pitch" and "last filter" registers, respectively. After that, the CPU 24 outputs note-off data (step S420), note-on data (step S421) and pitch-bend data and control-change data (step S410).

If, on the other hand, the variables "pitch" and "last pitch" match each other as determined at step S422, the CPU 24 goes to step S424, where it is determined whether the variables "filter" and "last filter" match each other to thereby ascertain whether or not there has been a change in the value of tone color filter modification data. Namely, even when no change is detected in the note number and pitch-bend data, the CPU 24 judges that a change has occurred in the fingering, as long as there is a change in the tone color filter modification data. If the variables "filter" and "last filter" do not match each other as determined at step S424, the CPU 24 proceeds to step S425 in order to set the variable "filter" into the "last filter" register. After that, the CPU 24 goes to step S420 to execute the above-mentioned operations of steps S420, S421 and 410. If, on the other hand, an affirmative determination is made at step S424, it means that there is no change in the fingering and there is no need to control the tone being generated, so that the CPU 24 loops back to step S411 of FIG. 20A.

For better understanding, the operations of the above-mentioned steps will be explained in greater detail. For example, as the player starts blowing with a basic-fingering key operation for note "A" as denoted at ③ in FIG. 5, the note number, say "69", of note "A" is set into the "note number" register. Because the tone-pitch and tone-color modification amounts are both zero in this case, control is performed to generate a tone of note "A" corresponding to the note number "69" with no particular tone-pitch and tone-color modification.

When a special-alternate-fingering key operation is applied for note "A" as denoted at ③ in FIG. 19A while the player still continues blowing, an affirmative determination is made at step S412 and the operations at and after step S414 are carried out; more specifically, step S416 determines a performed note number "70" greater by one than the note number of note "A", step S417 determines "−90" (−(100−10)) cents as pitch-bend data as well as "−20" as tone color filter modification data.

Now that the variables "note number" and "last note" does not match each other, a negative determination is made at step S418, so that the CPU 24 goes to step S419. In this case, note-off data is output at step S420 in order to mute the tone "A" having been sounded so far, and then note-on data containing note number "70" is output, along with control-change data containing pitch-bend data of "−90" cents and tone-color filter modification data of "−20", to newly generate a tone ("A'") corresponding to the note number "70" indicative of an alternate-fingering key operation for note "A" at steps S421 and S410. In response to these data, the tone generator section 241 generates, as the tone "A'" corresponding to the alternate-fingering key operation for note "A", a pitch shifted by "−90" cents from the note determined by the note number "70" (i.e., note "A#" 100 cents higher than note "A"), namely, a tone pitch-shifted by "+10" from the regular pitch of note "A". By so doing, pitch-bend control by "+10" cents is achieved for the alternate-fingering key operation as denoted at ② by arrow A in FIG. 19A. Also, the tone color is controlled to slightly differ from a predetermined tone color based on the basic fingering for note "A", in accordance with the "−20" control-change data containing pitch-bend data.

When, for example, the player terminates the special-alternate-fingering key operation for note "A" to restore the basic fingering while still maintaining his or her blow, the note number "69" of note "A" is set at step S416, and "0" cent is set as the pitch-bend data and tone-color filter modification data at step S417. Now that the variables "note number" (69) and "last note" (70) does not match each other, a negative determination is made at step S418, so that note-off data is output at step S420 in order to mute the tone "A'" corresponding to the special-alternate-fingering key operation, and then note-on data is output at step S421 for note "A" to be newly sounded, along with control-change data containing pitch-bend data indicative of "0" cent and tone-color filter modification data of "0" at step S410.

The present invention should not be construed as being limited to the preferred above-described embodiments and may be modified in a variety of manners such as set forth below.

Whereas the embodiments have been described above as controlling the tonal characteristics in accordance with a selected style or mode of operating the performance keys, a switch for cancelling the tone control may be provided such that even beginner-class players can easily vary the operating style. Further, the embodiments have been described above as controlling the operating style by detecting the depression states of the performance keys. Alternatively, the key depression strokes or velocities may be detected, in which case too the ON/OFF states of the keys may be determined depending on whether or not the detected stroke or velocity values are above a predetermined threshold value.

Furthermore, the embodiments have been described above as determining the keys to be in the ON state when their KP (A/D-converted depression force) values are in the range of "1" to "10" and in the OFF state when their KP values are "0". Alternatively, the criterion to determine the ON/OFF states of the individual keys may be set in any optional manner and varied as desired by the player. For example, each of the keys presenting the KP value above "8" may be determined to be in the ON state, while each of the keys presenting the KP value not greater than a predetermined value, such as "8" or "3", may be determined to be in the OFF state. In this case, the slur control may be carried out by interpolating between the detected ON/OFF values. In addition, the KP values may be set to be within the value range of "0" to "100" rather than the above-described value range of "0" to "10". The KP values may be used as velocity information for tone control purposes, in which case the finer the KP values, the more subtle can be the tone control.

Figure 21:
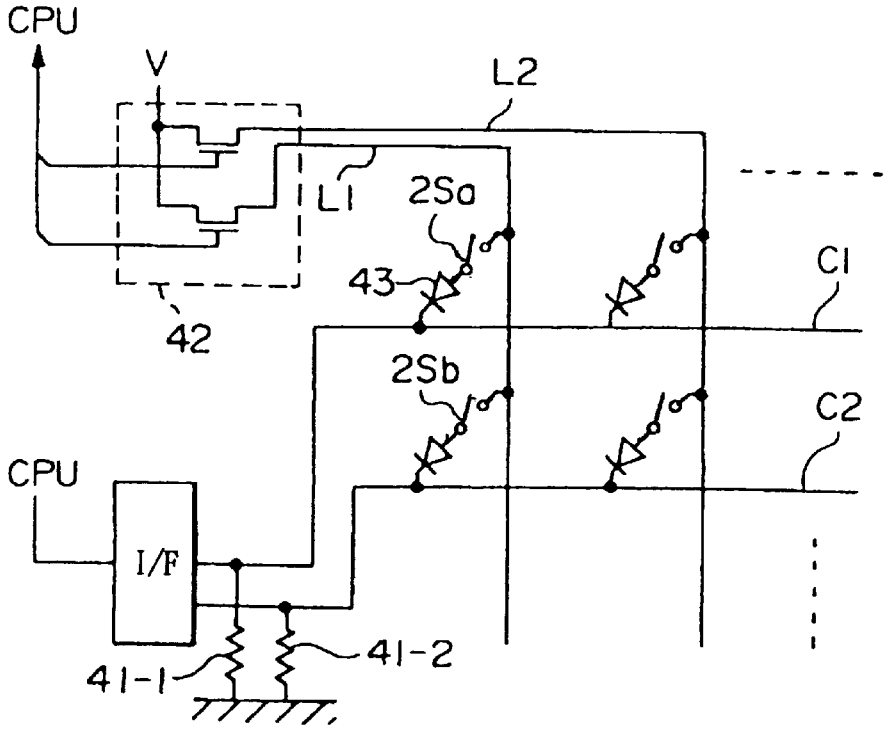
FIG. 21 is a diagram illustrating an exemplary setup of a modified key-sensor detector circuit employed in the embodiment.

Moreover, the key sensors 2Sa to 2Sp for detecting the key operations may be other than the analog sensor or multilevel-output type sensor (or digital multistep-output type sensor), such as simple ON/OFF-output type switches. In this case, the circuit of FIG. 4 may be modified in the manner as shown in FIG. 21. Such a modification will be very useful particularly in the third to fifth embodiments described above. In another modification, similar analog sensors may be used, rather than the simple ON/OFF-output type switches, as the above-mentioned key sensors 2Sa to 2Sp so that their outputs are A/D-converted, on the basis of a predetermined threshold value, to provide ON/OFF states of the corresponding keys. Alternatively, the A/D converted outputs of the analog sensors may be fed to the CPU, where they are subjected to software processing including comparison with a predetermined threshold value and resultant identification of ON/OFF states of the corresponding keys.

Furthermore, a plurality of different fingering charts for the basic fingering and special alternate fingering may be prepared and prestored so that any desired one of the charts can be selected and that notes and tone-pitch modification and tone-color modification amounts are determined on the basis of the selected chart. In this case, the number of pitch-designating keys would differ depending on a musical instrument to be approximated by the invention, and thus, with a musical instrument requiring only a smaller number of the performance keys, those keys, actually not used for pitch designation, may be used for the purpose of generating a tone control signal.

Further, whereas the embodiments have been described above storing in memory a table corresponding to fingering charts for the purpose of tone pitch designation, a similar table may be constructed by use of a logic circuit in the form of a diode matrix or by predetermined arithmetic operations (using predetermined algorithms to carry out note detection corresponding to the fingering charts).

Furthermore, each desired note may be entered via such an arrangement where notes are caused to correspond to the keys on a one-to-one basis, rather using a plurality of the keys as in natural wind instruments.

It is important to note that the described technique of performing or designating an intermediate pitch in accordance with the present invention is applicable to other electronic musical instruments than electronic wind instruments, such as keyboards.

Further, the basic concept of the present invention described above is also applicable to musical performance input devices or instruments which have no tone generating function, other than the electronic wind instrument or electronic musical instrument having a tone generating function as described above.

The present invention, having been described so far in relation to the several preferred embodiments, affords a variety of advantageous results, among which are as follows.

First, by controlling tonal characteristics on the basis of detection of player's key depression force, the present invention greatly facilitates a slur performance for interconnecting two different pitches and operations for varying tone color or the like by after-touch. Also, the present invention facilitates control of tone color, volume, pitch, etc. by permitting a changeover in the function of some selected keys. With such arrangements, the present invention provides an electronic wind instrument which affords highly enhanced performability and diversified performance expression.

Because of the arrangement that note-on information is newly issued, in response to execution of a predetermined form of alternate fingering, to thereby instruct that a tone be generated with "attack" characteristics, the tone generation can be controlled with the "attack" characteristics even though tone generation control, such as by breath pressure from the mouthpiece, is instructing sustention of the generated tone. Thus, when a predetermined key operation corresponding to the predetermined alternate fingering is executed or added in the course of a performance based on the basic fingering for a desired note, it can be determined properly that the desired note has been performed in accordance with the predetermined alternate fingering and the same desired note can be determined. Also, because a tone corresponding to the determined note can be generated with "attack" characteristics, it is possible to impart significant modulation to the performed tone to thereby achieve enhanced performance expression, even though the generated tone is of the same note as the last tone.

Further, the special alternate fingering can be approximated even more appropriately, by generating predetermined tone-color control information and tone-pitch control information in response to execution of a key operation corresponding to the alternate fingering, to thereby subtly control the color and pitch of the generated tone in a variable manner.

Furthermore, by, in response to a key operation corresponding to the predetermined alternate fingering, newly issuing note-on information designating a note differing, by a semitone, from a desired note corresponding to the basic fingering and also generating pitch control information instructing that the note designated by the note-on information be shifted in pitch toward the desired note by a predetermined number of cents, generation of the new tone can be initiated and controlled uniquely as a completely different note from the last tone. With this arrangement, the present invention can impart diversified expression to the performed tone.

What is claimed is:

1. An electronic musical instrument comprising:

a plurality of keys that are operated to designate a pitch;

a plurality of sensors each of which detects an operating state of a different one of said keys;

a main pitch determination section that identifies respective ON/OFF states of said keys on the basis of output values from said sensors and determines a designated pitch on the basis of the respective ON/OFF states of said keys;

a subsidiary pitch determination section that, when the output value from said sensor, corresponding to a particular one of said keys determined by said main pitch determination section to be in the ON or OFF state, presents a predetermined intermediate value, determines another pitch on the basis of predetermined assumptive ON/OFF states of said keys, said assumptive ON/OFF states being similar to the ON/OFF states of said keys identified by said main pitch determination section except that the ON or OFF state of said particular key is inverted to the OFF or ON state; and a pitch-bend information generation section that, when said other pitch is determined by said subsidiary pitch determination section, generates pitch-bend information designating an intermediate pitch between said other pitch and said pitch determined by said main pitch determination section.

2. An electronic musical instrument as recited in claim 1 wherein said pitch-bend information generation section determines the intermediate pitch on the basis of the output value from said sensor corresponding to a particular one of said keys.

3. An electronic musical instrument as recited in claim 1 wherein said pitch-bend information generation section determines the intermediate pitch on the basis of the output value from said sensor, corresponding to the particular one of said keys, presenting the predetermined intermediate value.

4. An electronic musical instrument as recited in claim 1 wherein when the output values from said sensors, corresponding to particular ones of said keys, present the predetermined intermediate value, said pitch-bend information generation section determines the intermediate pitch on the basis of the output value from said sensor corresponding to a predetermined one of the particular keys.

5. An electronic musical instrument as recited in claim 1 wherein when the output values from said sensors, corresponding to particular ones of said keys, present the predetermined intermediate value, said pitch-bend information generation section determines the intermediate pitch on the basis of the output values from said sensors corresponding to predetermined ones of the particular keys.

6. An electronic musical instrument as recited in claim 1 wherein the intermediate pitch is intermediate between pitches of scale notes, rather than any one of the pitches of scale notes themselves.

7. An electronic musical instrument as recited in claim 1 wherein said pitch-bend information generation section determines the intermediate pitch by interpolation.

8. An electronic musical instrument as recited in claim 1 wherein said pitch-bend information generation section generates the pitch-bend information when a difference between the pitch determined by said main pitch determination section and the other pitch determined by said subsidiary pitch determination section is within a predetermined interval.

9. An electronic musical instrument as recited in claim 8 wherein said predetermined interval is a whole tone or semitone.

10. An electronic musical instrument as recited in claim 1 wherein said subsidiary pitch determination section determines the other pitch only when the output value from said sensor corresponding to a particular one of said keys presents the intermediate value.

11. An electronic musical instrument as recited in claim 1 which further comprises a mouth operator that approximates a player's blow for controlling generation of a tone, so as to provide an electronic wind instrument.

12. An electronic wind instrument comprising:

a mouth operator that approximates a player's blow for controlling generation of a tone;

a plurality of keys that are operated to designate a pitch;

a plurality of sensors each of which detects an operated amount of a different one of said keys;

a pitch determination section that identifies respective ON/OFF states of said keys on the basis of output values from said sensors and determines a designated pitch on the basis of the respective ON/OFF states of said keys; and a tone control signal generation section that generates a tone control signal on the basis of the output value from said sensor corresponding to a predetermined one of said keys determined by said pitch determination section to be in the ON state, wherein a pitch of the tone controlled by said mouth operator is determined by said pitch determination section, the tone is controlled by the tone control signal, and when two or more of said keys are determined to be in the ON state, one of said keys in the ON state which is located most remotely from said mouth operator is selected as said predetermined key.

13. An electronic wind instrument comprising:

a mouth operator that approximates a player's blow for controlling generation of a tone;

a plurality of keys that are operated to designate a pitch, said plurality of keys including at least one predetermined key operable as a multifunctional key;

a mode selection section that selectively places a function of said predetermined key in one of pitch-designating and tone-controlling modes;

a pitch determination section that determines a designated pitch on the basis of respective ON/OFF states of all of said keys, including the predetermined key, when the predetermined key is placed in the pitch-designating mode, said pitch determination section determining the pitch on the basis of the ON/OFF states of said keys, excluding the predetermined key, when the predetermined key is placed in the tone-controlling mode; and a tone control parameter generation section that, when the predetermined key is placed in the tone-controlling mode, generates a tone control parameter on the basis of an output of the predetermined key, wherein a pitch of the tone controlled by said mouth operator is determined by said pitch determination section and the tone is controlled by the tone control parameter.

14. An electronic wind instrument as recited in claim 13 wherein the predetermined key is a high trill key.

15. An electronic wind instrument as recited in claim 13 wherein the predetermined key is an octave-controlling key.

16. An electronic wind instrument as recited in claim 13 wherein the tone control parameter is a parameter for controlling a tone-color factor.

17. An electronic wind instrument as recited in claim 13 wherein the output value from said sensor corresponding to the predetermined key presents a value corresponding to an operated amount of the predetermined key, and the tone control parameter presents a content corresponding to the output value from said sensor corresponding to the predetermined key.

18. An electronic wind instrument comprising:

a mouth operator that approximates a player's blow for controlling generation of a tone;

a plurality of keys that are operated to designate a pitch;

a pitch determination section that determines a pitch on the basis of a combination of respective operating states of said keys;

an octave control operator that is operated to modify, by the octave, the pitch determined by said pitch determination section;

a mode selection section that selectively places a function of said octave control operator in one of octave-controlling and tone-controlling modes, only octave control corresponding to the operating state of said octave control operator being executed when said octave control operator is in the octave-controlling mode, tone control corresponding to the operating state of said octave control operator being permitted when said octave control operator is in the tone-controlling mode; and a tone control parameter generation section that, when said octave control operator is in the tone-controlling mode, generates a tone control parameter in accordance with the operating state of said octave control operator.

19. An electronic wind instrument comprising:

a mouth operator that approximates a player's blow for controlling generation of a tone;

a plurality of keys that are operated to designate a pitch;

a pitch determination section that determines a pitch on the basis of a combination of respective operating states of said keys;

an octave control operator that is operated to modify, by the octave, the pitch determined by said pitch determination section;

a mode selection section that selectively places a function of said octave control operator in one of octave-controlling and tone-controlling modes, only octave control corresponding to the operating state of said octave control operator being executed when said octave control operator is in the octave-controlling mode, tone control corresponding to the operating state of said octave control operator being permitted when said octave control operator is in the tone-controlling mode; and a tone control parameter generation section that, when said octave control operator is in the tone-controlling mode, generates a tone control parameter in accordance with the operating state of said octave control operator, wherein said octave control operator includes a plurality of control keys, and wherein said octave control operator in the octave-controlling mode is capable of executing any one of different forms of the octave control depending on a combination of said control keys, while said octave control operator in the tone-controlling mode permits a selection between execution of the octave control and generation of the tone control parameter depending on a combination of said control keys.

20. An electronic wind instrument comprising:

a plurality of note-performing keys;

a note determination section that determines a performed note on the basis of a combination of respective operating states of said keys, said note determination section being capable of determining a specific note on the basis of a predetermined combination of the operating states of said keys corresponding to basic fingering for the specific note and also on the basis of a predetermined combination of the operating states of said keys corresponding to predetermined alternate fingering for said specific note; and a control section that, when the predetermined alternate fingering is executed, newly issues note-on information corresponding to the predetermined alternate fingering, said control section instructing that a tone corresponding to the note determined by said note determination section be generated with attack characteristics in response to issuance of the note-on information.

21. An electronic wind instrument comprising:

a plurality of note-performing keys;

a note determination section that determines a performed note on the basis of a combination of respective operating states of said keys, said note determination section being capable of determining a specific note on the basis of a predetermined combination of the operating states of said keys corresponding to basic fingering for the specific note and also on the basis of a predetermined combination of the operating states of said keys corresponding to predetermined alternate fingering for said specific note; and a control section that, when the predetermined alternate fingering is executed, newly issues note-on information corresponding to the predetermined alternate fingering, said control section instructing that a tone corresponding to the note determined by said note determination section be generated with attack characteristics in response to issuance of the note-on information, wherein when the predetermined alternate fingering is executed, said control section newly issues note-on information designating a note differing, by a semitone, from the specific note corresponding to the basic fingering and also generates pitch control information instructing that the note designated by the note-on information be shifted in pitch toward the specific note by a predetermined number of cents.

22. An electronic wind instrument as recited in claim 20 which further comprises a mouth operator that approximates a player's blow for controlling generation of a tone.

23. A method of designating an intermediate pitch between designatable notes in an electronic musical instrument which includes a plurality of keys for being operated to designate a note and a plurality of sensors each for detecting an operating state of a different one of said keys, said method comprising:

a first step of identifying respective ON/OFF states of said keys on the basis of output values from said sensors and determining a note on the basis of the respective ON/OFF states of said keys;

a second step of, when the output value from said sensor, corresponding to a particular one of said keys determined to be in the ON or OFF state, presents a predetermined intermediate value, determining another pitch on the basis of predetermined assumptive ON/OFF states of said keys, said assumptive ON/OFF states being similar to the ON/OFF states of said keys identified by said first step section except that the ON or OFF state of said particular key is inverted to the OFF or ON state; and a third step of, when said other pitch is determined by said second step, generating information designating an intermediate pitch between said other pitch and said pitch determined by said first step.

24. A method of generating a tone based on alternate fingering in an electric musical instrument which includes a plurality of note-performing keys, said method comprising:

a first step of determining a performed note on the basis of a combination of respective operating states of said keys, said first step being capable of determining a specific note on the basis of a predetermined combination of the operating states of said keys corresponding to basic fingering for the specific note and also on the basis of a predetermined combination of the operating states of said keys corresponding to predetermined alternate fingering for said specific note; and a second step of, when the predetermined alternate fingering is executed, newly issuing note-on information corresponding to the predetermined alternate fingering, said second step instructing that a tone corresponding to the note determined by said first step be generated with attack characteristics in response to issuance of the note-on information.

25. A machine-readable recording medium containing a program for executing a method of designating an intermediate pitch between designatable notes in an electronic musical instrument which includes a plurality of keys for being operated to designate a desired note and a plurality of sensors each for detecting an operating state of a different one of said keys, said program comprising:

a first step of identifying respective ON/OFF states of said keys on the basis of output values from said sensors and determining a note on the basis of the respective ON/OFF states of said keys;

a second step of, when the output value from said sensor, corresponding to a particular one of said keys determined to be in the ON or OFF state, presents a predetermined intermediate value, determining another pitch on the basis of predetermined assumptive ON/OFF states of said keys, said assumptive ON/OFF states being similar to the ON/OFF states of said keys identified by said first step section except that the ON or OFF state of said particular key is inverted to the OFF or ON state; and a third step of, when said other pitch is determined by said second step, generating information designating an intermediate pitch between said other pitch and said pitch determined by said first step.

26. A machine-readable recording medium containing a program for executing a method of generating a tone based on alternate fingering in an electronic musical instrument which includes a plurality of note-performing keys, said method comprising:

a first step of determining a performed note on the basis of a combination of respective operating states of said keys, said first step being capable of determining a specific note on the basis of a predetermined combination of the operating states of said keys corresponding to basic fingering for the specific note and also on the basis of a predetermined combination of the operating states of said keys corresponding to predetermined alternate fingering for said specific note; and a second step of, when the predetermined alternate fingering is executed, newly issuing note-on information corresponding to the predetermined alternate fingering, said second step instructing that a tone corresponding to the note determined by said first step be generated with attack characteristics in response to issuance of the note-on information.

* * * * *